United States Patent [19]

Williamson

[11] Patent Number: 4,545,441

[45] **Date of Patent: * Oct. 8, 1985**

[54] DRILL BITS WITH POLYCRYSTALLINE DIAMOND CUTTING ELEMENTS MOUNTED ON SERRATED SUPPORTS PRESSED IN DRILL HEAD

[76] Inventor: Kirk E. Williamson, Corpus Christi, Tex.

[ * ] Notice: The portion of the term of this patent subsequent to Feb. 7, 2001 has been disclaimed.

[21] Appl. No.: 574,167

[22] Filed: Jan. 26, 1984

Related U.S. Application Data

[63] Continuation-in-part of Ser. No. 237,971, Feb. 25, 1981, Pat. No. 4,429,755.

[51] Int. Cl.[4] ..... E21B 10/46

[52] U.S. Cl. ..... 175/329; 175/410

[58] Field of Search ..... 175/327, 329, 339, 410, 175/413

[56] References Cited

U.S. PATENT DOCUMENTS

| | | | |
|---|---|---|---|
| 3,603,414 | 9/1971 | Stebley | 175/410 |
| 3,871,488 | 3/1975 | Sabre | 175/410 |
| 4,323,130 | 4/1982 | Dennis | 175/410 |
| 4,360,069 | 11/1982 | Davis | 175/410 |
| 4,429,755 | 2/1984 | Williamson | 175/329 |
| 4,473,125 | 9/1984 | Addudle et al. | 175/410 |

*Primary Examiner*—Stephen J. Novosad
*Assistant Examiner*—William P. Neuder
*Attorney, Agent, or Firm*—Penrose Lucas Albright

[57] ABSTRACT

Drill bit for drilling bore holes in earth formations, the bit's cutting face provided with cutter preforms composed of polycrystalline diamonds on a tungsten carbide substrate mounted in sets from the center of the bit's face to its periphery. The first set consists of one center cutter preform. Each succeeding set has at least two preforms, all of which in a set are disposed at an equal radius from the bit's axis of rotation and, insofar as practical, are displaced from adjacent preforms in the same set by equal arcs around the axis, the cutting path of a set overlapping with that of the next set, the distance along the path between preforms for each set being not greater than about five inches. The outermost preform set is disposed in or above the junk slots.

Gage protectors are optionally placed on the drill bit's sides to hold it away from the casing, such gage protectors composed of aluminum which wears to the diameter of the drill bit during use or a resilient material which compresses to the overall diameter of the drill bit during drilling operations and prevents damage to or from the casing when the bit is lowered or withdrawn. The drill bit is conveniently manufactured in three parts, a pin shank, a body spacer and a cap, with the body spacer welded to both the cap and the pin shank, the latter being threadably received through the body spacer by the cap, thus placing the body spacer in a state of compression.

27 Claims, 30 Drawing Figures

270
271
272
273
274
275
276
277
278
279
280
209
210
212
232
233
237
240
241
125
127
131
42

DRILL BITS WITH POLYCRYSTALLINE DIAMOND CUTTING ELEMENTS MOUNTED ON SERRATED SUPPORTS PRESSED IN DRILL HEAD

RELATED APPLICATION

This is a continuation-in-part application of application Ser. No. 237,971, filed Feb. 25, 1981, now U.S. Pat. No 4,429,755.

BACKGROUND OF THE INVENTION

The invention relates to a rotary drill bit for drilling oil and gas wells and, more particularly, to a drill bit suitable for up to hard formations having cutting preforms of polycrystalline diamonds on tungsten carbide substrates.

In rotary drilling, the bit is fixed on the end of a rotating drill pipe inside a casing, the drill pipe being lowered as the drilling progresses. A heavy artificial substance known as drilling mud is circulated down through the drill pipe, out through the bit and back up the casing to remove rock fragments. The drilling mud cools the bit, washes the cutting elements so they present a clean cutting face where the cutting takes place and, as indicated, lifts or carries debris resulting from the drilling to the surface. For the drilling mud to carry out these functions, it is necessary that its velocity through the bit's fluid entrances and channels be high without causing an undesirably high back pressure so it moves quickly across the face and is discharged rapidly and efficiently up the junk slots. It is important clogging of the bit be prevented with rapid removal of cuttings and also that undue stress be avoided.

In lowering bits into a well where cutter elements extend normally from the bit's sides, damage to the casing or the bit or both may occur.

Drill bits, particularly larger drill bits for higher gages, are heavy and difficult to manufacture, requiring comparative large equipment for machining, welding and heat-treating. This is especially so for the head of the bit because of the need for applying gage pads to stabilize and properly position same.

Another problem has been the retention of the cutter preform elements which must be secured to the crown of the bit in an extremely rigid manner. The breakage of any such elements increases the cutting load of the next following cutting element in the set which is then more likely to break or be subjected to greater wear and abuse. These problems tend to reduce the average lifetime of the drill bit which is reflected in decreased efficiency and higher costs for the drilling operations.

Rapid penetration of the earth and longer runs improve substantially the efficiency of the drilling operations. Preform cutting elements as disclosed in U.S. Pat. Nos. 3,745,623, 3,767,371, 4,109,737 and 4,156,329 have been utilized by the inventor and others to provide improved penetration in soft to medium-hard formations such as salt, shale, anhydrite, carbonates, marls, clay and sandstones. But when drilling in harder formations, difficulties have been encountered. Solutions to such problems have been suggested as disclosed, for example, in U.S. Pat. No. 4,006,788 to L. Garner, which applies to a rotary drill bit provided with rolling cone cutters. This patent spells out the need for rotary rock bits which work well in various types of formations, soft or hard, encountered in deep wells where it is highly desirable to penetrate long distances before changing bits.

SUMMARY OF THE INVENTION

The invention involves the arrangement of the cutter preform elements, the shape of the drilling face, the relative proportions of the bit body, the structure of the fluid entrances, and the location and relative size of the junk slots to achieve a rock drill capable of relative rapid penetration in deep wells irrespective of the formations encountered. The bit, provided with cutter preform elements of polycrystalline diamonds on tungsten carbide substrates, penetrates rapidly relative to the formation involved and extends the drilling time before removal of the bit is required whereby costs per foot drilled are significantly reduced.

An important aspect of the invention lies in the arrangement of the cutter preforms in sets, the cutter preforms on each given set being disposed at equal radius from the bit's axis of rotation and from each other through equal arcs. Successive sets of cutter preforms remove the formation through which they are penetrating by cutting or shearing action, each set tracing a path which overlaps with the paths of the adjacent set or sets. The peripheral set of cutter preforms is secured within or adjacent to the junk slots and off-sets may be provided in alternately adjacent raised portions which both protect cutter preforms and ensure junk slots remain unclogged. Clogging is also minimized by proportions of the bit body wherein the overall diameter of the body is about twice its length measured along the raised portions which define the junk slots. The fluid entrances from the interior of the bit to its drilling face are of a converging-diverging type constructed from two components, a converging shaped jet element held in place by diverging jet holder component, the combined jet nozzle minimizing flow turbulence, erosion and corrosion which would otherwise result from sharp cornered and straight-necked nozzles.

Strong, but not larger than required, supports for cutter preform elements aid in minimizing resistance of flow of the drilling mud away from the drilling face. A rearward inclination of about 20° relative to a line perpendicular to the drilling face through the axis of the cutter preform element improves its impact resistance whereby energy required to remove a given amount of formation is substantially reduced. By making the supporting pins for the cutter preform elements of tungsten carbide, configuring its vertical sides to have vertically disposed serrations and pressing same into somewhat smaller openings in the drilling face, the tungsten carbide serrations cut into the sides of the openings and extremely strong and rigid connections are provided between the cutter elements and the bit's drilling face.

It has been found by securing gage protectors composed of aluminum or other soft metal or a resilient material between the gage pads, such protectors projecting beyond the overall diameter of the bit, including the gage pads and preform cutter elements extending normally from the sides of the bit, damage to the well's casing and to the drill bit when it is lowered into the casing is prevented. In a like manner the casing is prevented from damaging such preform cutter elements. In the subsequent drilling operation, the gage protectors, if aluminum or other soft metal, are worn down to the bit's overall diameter. If resilient material, they may last the lifetime of the drill bit, depending upon drilling conditions.

In manufacturing drill bits in accordance with the invention, principally the larger drill bits, it has been found advantageous to manufacture them in three major component parts, the pin shank, a body spacer which is supported by the pin shank, and a cap which is threadably received by the pin shank and welded to the body spacer. The weld of the body spacer is machined flush with the cylindrical side surfaces of the drill bit and gage pads are attached to the combined body spacer and cap to make it an integral unit. The last operation is to screw the pin shank to the internal threads of the cap which places the body spacer in compression and ensures it is properly centered, the body spacer subsequently being welded to the pin shank. The resulting structure is very strong and, at the same time, dynamically balanced. This three-part construction provides substantial advantages in the manufacture of such drill bits and, in addition, permits the use of the same pin shanks or various gages of drill heads. Potentially both the pin shank and the body spacer are reusable without the need for considerable redressing and machining of these parts.

Other objects, adaptabilities and capabilities of the invention will be appreciated by those skilled in the art as the description progresses, reference being had to the accompanying drawings, in which:

DESCRIPTION OF THE PREFERRED EMBODIMENTS

Figure 1:
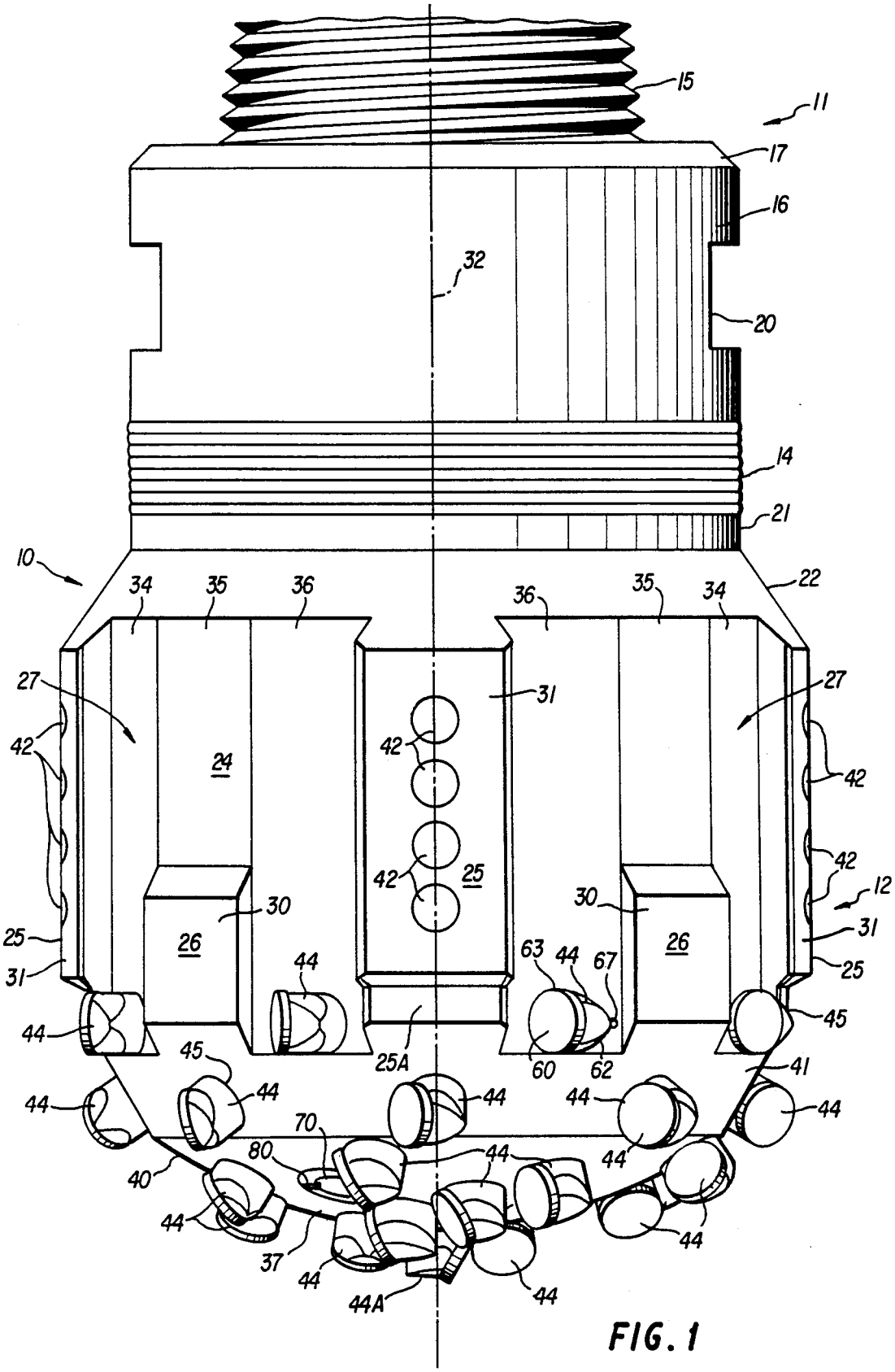
FIG. 1 is a side elevation of a drill bit in accordance with the invention.

Referring to the drawings, the drill bit indicated generally by reference numeral 10, consists of a pin shank 11 and a crown 12 rigidly connected by a weld 14.

Pin shank 11 includes a threaded connection 15 integral with a steel shank 16 which includes a shank bevel 17 and a breaker slot 20, also known as a keyway, for threading drill bit 10 onto the end of a rotating drill pipe not shown.

Crown 12 has a further shank portion 21 which, by weld 14 and internal threads 82 is rigidly affixed to shank 16 and forms a part thereof. Integral with shank portion 21 is the angle shoulder 22. Below shoulder 22 is a side surface 24 which includes four raised portions 25 and a further set of four raised portions 26 which alternate with portions 25. The latter raised portions 26 are each surrounded on three sides by a fluid channel known as a junk slot 27. Portions 26 have planar outboard surfaces 30 contrasting with the curved outboard surfaces 31 of each raised portion 25, each such latter surface 31 coinciding with a cylindrical surface having the same longitudinal axis as the bit's axis of rotation 32. Between adjoining portions 25, slots 27 have three adjoining planar surface strips 34, 35 and 36, the central strips 35 having the same width as the innermost parts of the corresponding portion 26. The bit's face 37 has a central convex portion 40 surrounded by a peripheral portion 41, portion 40 coinciding with a portion of a sphere having its center on the axis 32 and the portion 41 coinciding in part with a cone having its apex and longitudinal axis coinciding with axis 32.

Each raised portion 25 is provided with four gauge buttons 42 which are composed of tungsten carbide and press fitted in portions 25 flush with their outboard surfaces.

Figure 2:
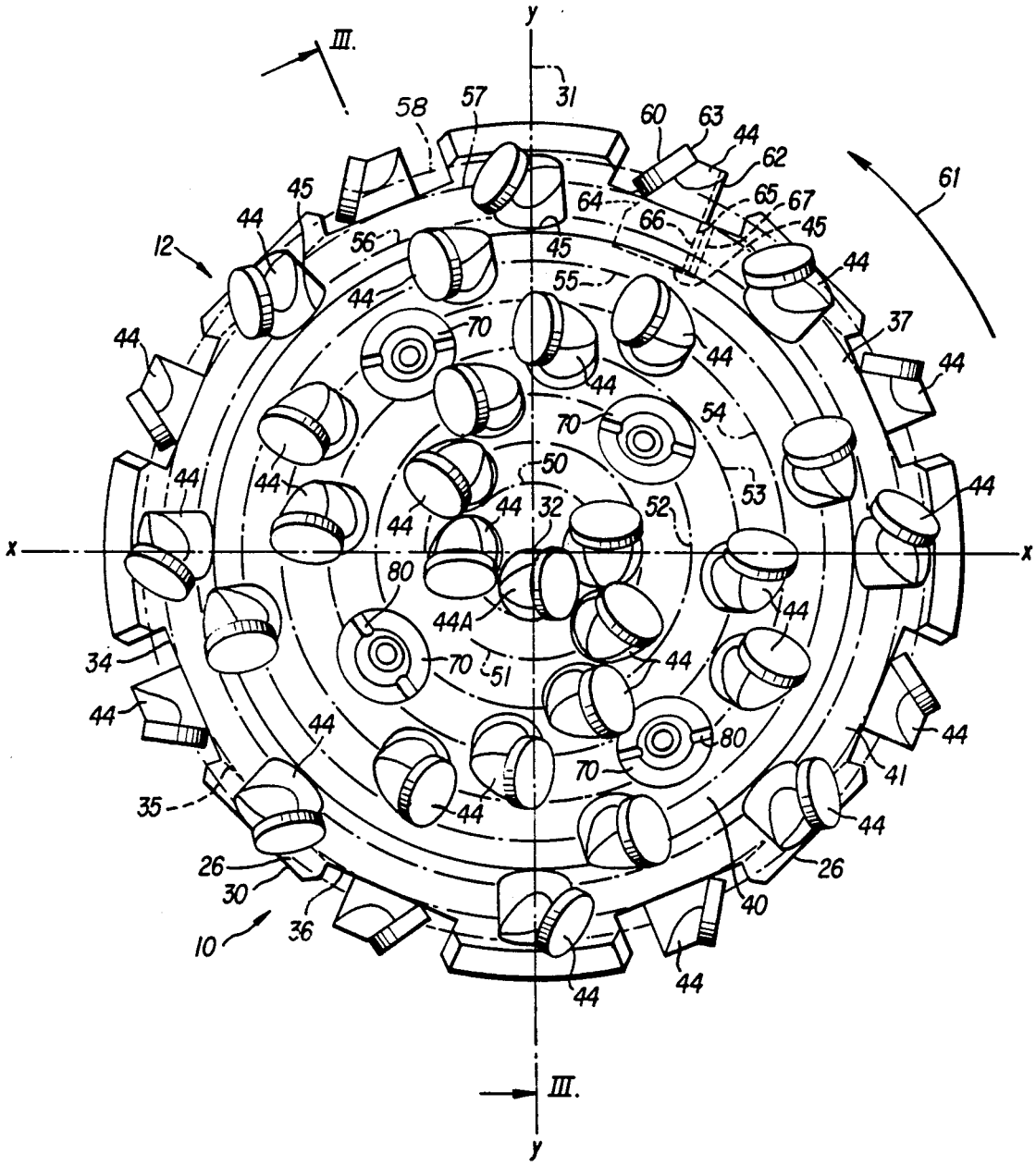
FIG. 2 is a bottom view, in the operational sense, of the drill bit shown in FIG. 1.

From FIG. 2, it will be noted that nineteen preform cutter elements 44 are mounted on convex portion 40, eight further preform elements 44 are mounted on conical portion 41 and a still further eight preform cutter element 44 are mounted in junk slots 27 between each raised portion 26 and an offset portion 25A of its succeeding raised portion 25 adjacent face portion 41. Thus, there are a total of twenty-seven preform cutter elements 44 which are mounted on the bit's face 37 and eight further elements 44 are mounted in junk slots 27, for a total of thirty-five cutter elements mounted on crown 12.

As seen in FIG. 2 the most central cutter element designated 44A preferably has an edge which coincides with axis of rotation 32 and succeeding sets of cutter elements 44 are received in successive sets of openings 45 which have their centers coincide with circles 50, 51, 52, 53, 54 and 55, respectively, on face portion 40, and circle 56 on face portion 41, succeeding circles 50 through 56 being shown in dot-dash lines and representing generally the cutting paths of successive sets of cutter elements 44. Commencing after cutting element 44A it will be noted the next three sets, for circles 50, 51 and 52, each have two cutter elements 44 whereas the next successive three sets, coinciding with circles 53, 54 and 55, respectively, each have four cutter elements 44. The last successive set of eight cutter elements 44 on fact portion 40 coincides with circle 56. Strips 34 and 36 are tangent to circle 57 which intercepts with the centers of openings 45 on such strips. Finally, the last set of cutter elements 44 have the center of their cutting blanks 60 rotate through a circle 58 which, as seen in FIG. 2, coincides with the outboard surfaces of the offset cylindrical portions 25A of each raised portion 25.

It should be appreciated each circle 50–55 passes through corresponding centerlines 48 on surface of the face portion 40 and each centerline 48 intersects axis 32 at the same point 33 as the radius for face portion 40. In the following Table I the angle between the centerline 48 involved and centerline 32 is indicated by the angle alpha ($\alpha$) for the centerline of opening 45 of element 44B and for circles 50 through 55. For the openings in the surface of portion 41 the axis of opening 45 is perpendicular to such surfaces and passes through axis 32. For circle 57, the axes of openings 45 are perpendicular to the axis 32. The radius of each circle 50 through 57 is also shown in Table I for succeeding circles together with the number of openings 45 and the angle from the vertical "y" axis as seen in FIG. 2 in a counterclockwise direction indicated by arrow 61, the operational direction of rotation of the bit, the angle of the intersection of each centerline with a corresponding circle 50 through 57 being also included in Table I.

TABLE I

| NO. OF OPENINGS | RADIUS | $\alpha$ REF. | ANGLE COUNTERCLOCKWISE FROM Y-AXIS OF EACH CENTERLINE 48 | CIRCLE NO. |
|---|---|---|---|---|
| 1 | .3254 | 3.54606° | 180° | |
| 2 | .6701 | 7.27076° | 90°, 270° | 50 |
| 2 | 1.0620 | 11.42479° | 45°, 225° | 51 |
| 2 | 1.4687 | 15.59926° | 15°, 195° | 52 |
| 4 | 1.8809 | 19.6577° | 82°, 172°, 262°, 352° | 53 |
| 4 | 2.2968 | 23.54162° | 60°, 150°, 240°, 330° | 54 |
| 4 | 2.7154 | 27.21963° | 15°, 105°, 195°, 285° | 55 |
| 8 | 3.1171 | PERPEND. TO THE SURFACE OF PORTION 41 | 0°, 45°, 90°, 135°, 180°, 225°, 270°, 315° | 56 |
| 8 | 3.3432 | PERPENDICULAR TO AXIS 32 | 22.5°, 67.5°, 112.5°, 157.5°, 202.5°, 247.5°, 292.5°, 337.5° | 57 |

Each cutter blank 60 is made of a combination of polycrystalline (man-made) diamonds and cemented tungsten carbide produced as an integral blank by a high-temperature, high pressure process developed by General Electric Company and currently marketed under the trademark "STRATAPAX." The particular blank is identified by General Electric's product No. 2542. Cutting elements of the type involved are disclosed in U.S. Pat. No. 4,109,737 of H. Bovenkerk which issued Aug. 29, 1978.

Each cutting blank 60 is mounted on a pin 62 and is bonded by brazing to a bias part 64 which is canted 20 degrees to the rearward relative to the centerline of pin 62, the opening 45 receiving pin 62.

Each cutter element 44 has at the rear of pin 62 a channel 65 which defines part of an opening 66, the other portion of opening 66 being defined in the crown 12 as shown. Such opening 66 receives a lock pin 67 to fix each cutter element 44 in the desired rake alignment.

To insert each cutter element 44, the material surrounding opening 45 is heated to a range of 1800° to 1900° F. and cutter element 44 is pressed into the opening 45 until the disc 63, on which cutting blank 60 is mounted, is pressing on the surface of the crown 12 with the channel 65 being aligned to define opening 66. The objective is to achieve a tight shrink-press fit combination. With the opening 66 properly aligned, lock pin 67 is pressed into place and the next cutter element 44 is placed in appropriate opening 45, by the same process, the sequence of openings and time for inserting each cutter element being such the temperature of face 37 does not exceed 1250° F. except in the immediate vicinity of the opening 45 involved.

Figure 4:
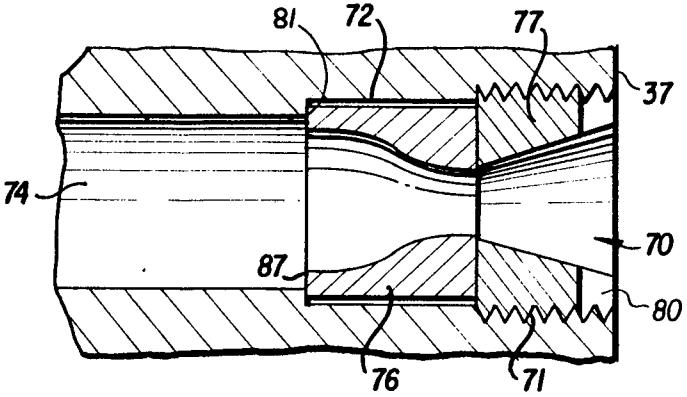
FIG. 4 is a detailed sectional view of a jet insertion taken on section lines IV—IV of FIG. 2.
Figure 5:
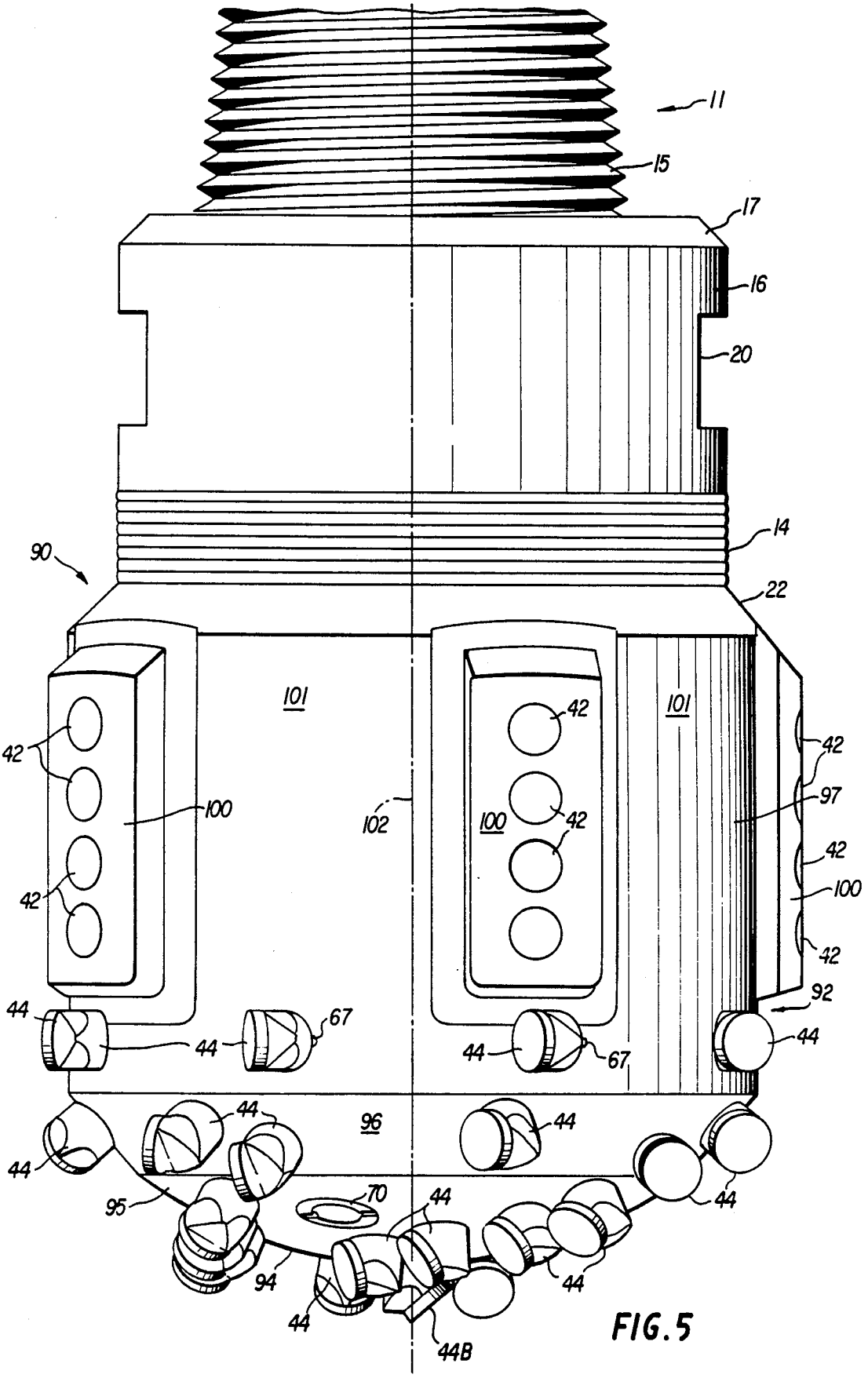
FIG. 5 is a side elevation of a further embodiment of a drill bit in accordance with the invention.

Referring to FIG. 4, a jet opening for supplying drilling mud in face 37 is shown. For the embodiment in FIG. 2 there are four such jet openings 70. Each opening 70 has a threaded portion 71, an enlarged portion 72 and a bore 74 which connects with fluid entrance 75.

Enlarged portion 72 receives a nozzle throat 76 which is sealed in portion 72 by a high temperature sealant such as, for example, the Haliburton "Howcoweld." A nozzle flared piece 77 is received in the threaded portion 71 and also sealed in place also by a high temperature sealant such as Haliburton's "Howcoweld." It will be noted nozzle piece 77 includes a pair of notches 80 for receipt of a tool for turning pieces 77 whereby it is received by threaded portion 71 and nozzle throat 76 is firmly seated against shoulders 87 which are disposed between bore 74 and enlarged portion 72.

The surface of drill bit 10 may be, if desired, case hardened to minimize undesirable scarring of the bit during operation.

In field tests, drill bits constructed in accordance with the invention have operated as follows:

| TEST NO. | STRATA | FEET DRILLED | HOURS DRILLED | COST PER FOOT |
|---|---|---|---|---|
| 1 | Shale and Sand | 1766 | 47.5 | $20.10 |
| 2 | Shale | 1499 | 40 | $22.10 |
| 3 | Shale | 1520 | 48.3 | $23.72 |

The following observations were made from field tests:

1. Retention of cutting elements in the drilling bit was excellent.
2. The bit operated very well in strata of all types including hard strata.
3. The cost per foot drilled by drilling bits in accordance with the invention compared with conventional bits frequently provided savings in the range of fifty to one hundred percent.
4. The effective life of the bit for hard formations is about forty-eight hours in which period roughly a penetration of 1500 to 1800 feet can be reasonably anticipated.
5. The wear on individual cuter elements increased as their distance from the axis of rotation increased.
6. There was a need to increase the flow areas for the drilling mud to minimize loss of effective jet action.
7. Recirculation of junk in the drilling mud may be a source of difficulty and should be minimized.

As a result of the foregoing observations, modifications were incorporated in the bit whereby the further embodiment illustrated in FIGS. 5 through 9 was constructed. This drill bit, designated generally by reference numeral 90, has a pin shank 11 which is essentially the same as that of the first embodiment. Here and with other components similar to those in the first embodiment, the same reference numerals are used. Thus, in crown 92 of drill bit 90, gauge buttons 42 and preform cutter elements 44 are essentially identical to those shown in the first embodiment. However, it will be recognized the placement of such elements on crowns 12 and 92 is different.

Crown 92 includes a bit face 94 which has a convex portion 95 and a conical portion 96 which coincides with the surface of a truncated cone.

The cylindrical sides or surface 97 of crown 92 have five raised portions 100 welded thereto. Such raised portions including four openings each receiving gauge buttons 42. Thus with five raised portions 100, twenty gauge buttons 42 are required. Preferred are serrated compact General Electric type gauge buttons (No. 59S3AH) which are pressed to be flush with the surface.

The spaces between raised portions 100, which are identified by reference numerals 101, function as junk slots and it will be noted raised portions corresponding to portions 26, as shown in the first embodiment, have been eliminated in this embodiment. The total area of spaces 101 is roughly double that occupied by portions 100. The purpose is to maximize space provided for discharge of drilling mud while retaining sufficient surface through raised portions 100 to maintain drill bit 90 in its proper location relative to the shaft which is being carved out by the drill bit.

The axis of rotation of drill bit 90 is axis 102. Convex portion 95 of face 94 has a radius of 5.25 inches from a point 103 on axis 102. The diameter of surface 97 is 7.45 inches and the radius of portion 95 as seen from above is 2.99 inches. The overall diameter of the crown 92, considered as a cylinder coinciding with the surfaces of raised portions 100 is 8.467 inches. However, it will be noted from FIG. 6 the preform cutter elements farthest from axis 102 circumscribe a circle having a somewhat greater diameter of 8.495 inches. Thus, the tops of the outmost cutting blanks 60, as manufactured, cut an opening somewhat larger than the diameter circumscribed by the outer surfaces of raised portions 100.

Figure 6:
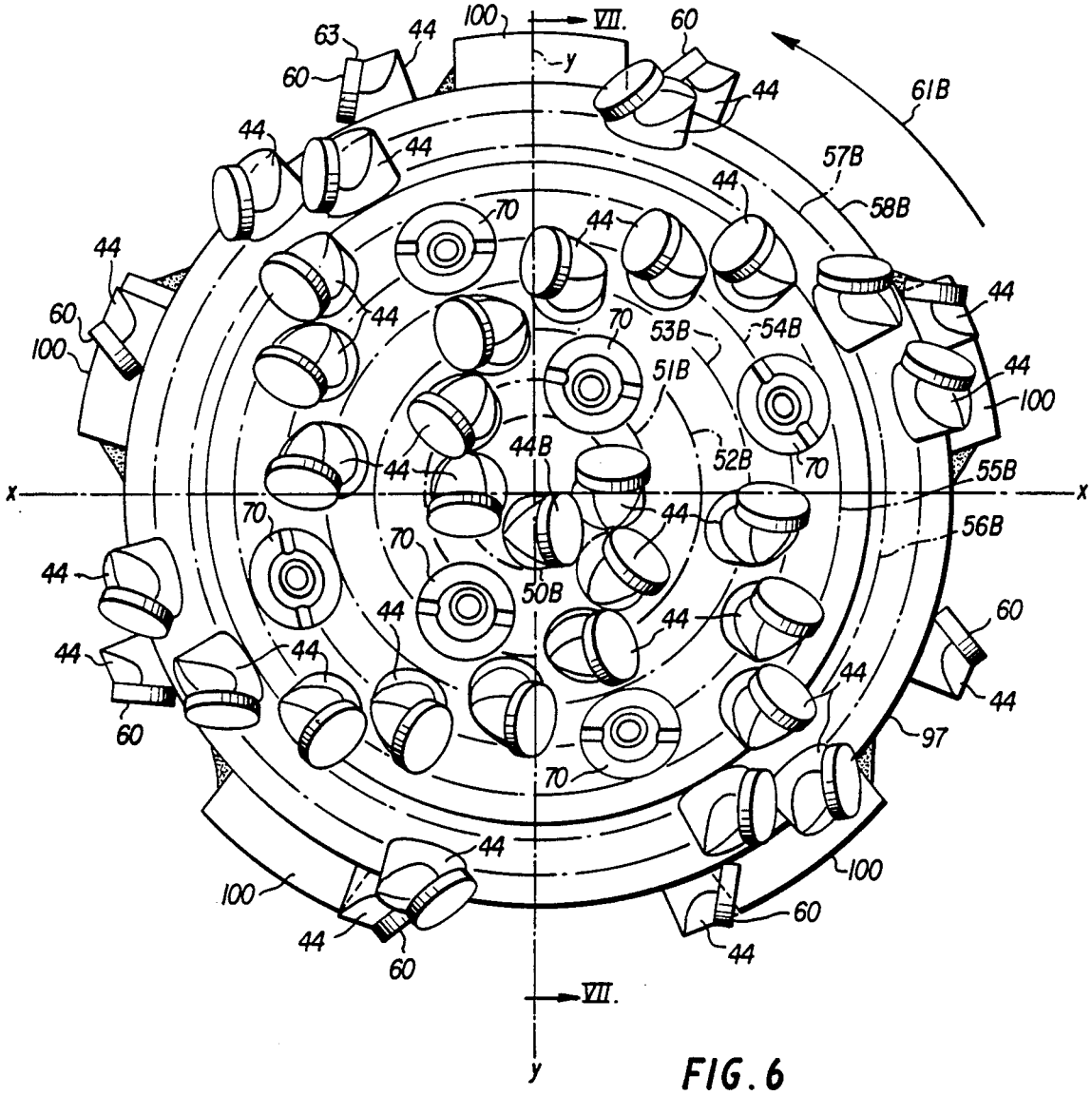
FIG. 6 is a view, similar to FIG. 2, of the embodiment shown in FIG. 5.

The precise locations of preform cutter elements 44 on crown 92, as shown in FIG. 6, are set forth in the following Table II.

TABLE II

| NO. OF OPENINGS | RADIUS | α REF. | ANGLE COUNTERCLOCKWISE FROM Y-AXIS OF EACH CENTERLINE 48 | CIRCLE NO. | RAKE ANGLE |
|---|---|---|---|---|---|
| 1 | .3254 | 3.554° | 180° | | |
| 2 | .6701 | 7.333° | 90°, 270° | 50B | 7.5 |
| 2 | 1.082 | 11.894° | 45°, 225° | 51B | 7.5 |
| 2 | 1.4884 | 16.469° | 15°, 195° | 52B | 7.5 |
| 4 | 1.9009 | 21.227° | 82°, 172°, 262°, 352° | 53B | 5 |
| 4 | 2.3168 | 26.187° | 60°, 150°, 240°, 330° | 54B | 5 |
| 4 | 2.7354 | 31.401° | 45°, 135°, 225°, 315° | 55B | 5 |
| 4 | 3.0971 | (1) | 30°, 120°, 210°, 300° | 56B | 0 |
| 6 | 3.511 | (2) | 43°, 103°, 163°, 223° 283°, 343° | 57B | −5 |
| 8 | 3.72 | PERPENDICULAR TO SURFACE | 22.5°, 67.5°, 112.5° 157.5°, 202.5°, 247.5° 292.5°, 337.5° | 58B | −5 |

(1) Perpendicular to 56.7°
(2) Perpendicular to 56.7°

Figure 7:
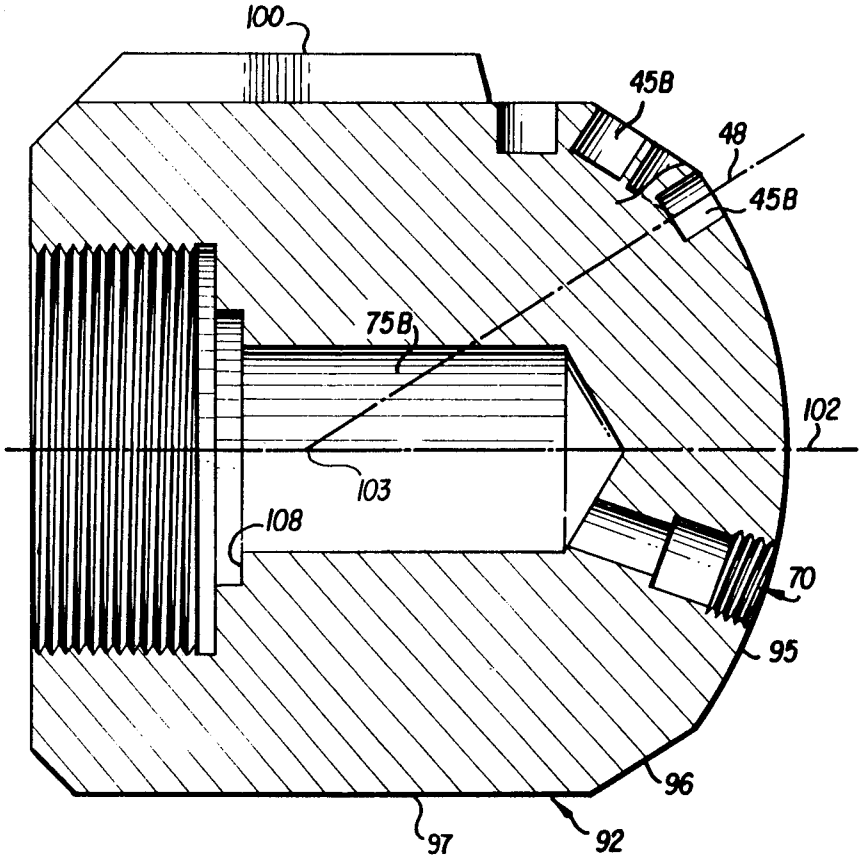
FIG. 7 is a sectional view of the crown of the bit of FIGS. 5 and 6 taken on seciton line 7—7 of FIG. 6.
Figure 3:
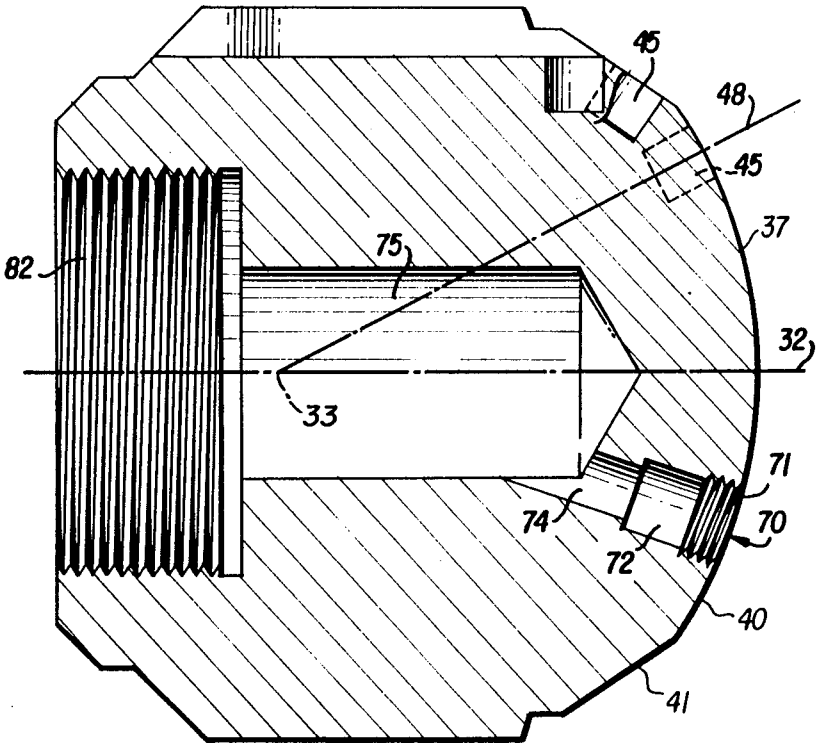
FIG 3 is a side sectional view taken on section lines III—III of FIG. 2.

Comparison of Table II with Table I reveals that following the most central cutter element 44A in FIG. 2 and 44B in FIG. 6, there are eight additional sets of cutter elements 44 in FIG. 2 whereas in FIG. 6 there are nine additional sets of cutter elements 44, such sets being in corresponding circles 50B through 58B. In Table II, the radius of each circle 50B through 58B is measured perpendicular to axis 102. The angle alpha (α) is the number of degrees of the axis 48 of the opening involved from the axis 102 as seen in FIG. 7. For element 44B and elements on circles 50B to 55B, angle α is measured from point 103. For elements on circles 56B and 57B it is perpendicular to the surface of portion 96. Circle 58B is coincident with surface 97 and angle α is perpendicular to surface 97 and to centerline 102. The next column shows the number of degrees in a counterclockwise direction indicated by arrow 61B, also the operational direction of the bit, from the "y" axis of a plane coincident with centerline 102 which contains centerline 48 for each cutter element 44 which intercepts with a corresponding circle 50B through 58B. In addition, as will be understood by reference to FIG. 9, the rake angle of the elements faces (viewed along their corresponding axis 48) has been modified from zero degrees of cutter elements 44 in the first embodiment to a plus 7½ for preform cutter elements 44 in circles 50B, 51B and 52B and a plus 5° for preform cutter elements 44 in circle 53B, 54B and 55B. Preform cutter elements 44 in circle 56B have a zero rake angle, whereas cutter elements 44 in circles 57B·and 58B has a minus 5° rake angle.

In view of the foregoing, it will be appreciated as seen in FIG. 6, the most central cutter element designated 44B has an edge which preferably coincides with the axis of rotation 102 and succeeding sets of cutter elements 44 are received in successive sets of openings 45B which have their centers coincide with circles 50B, 51B, 52B, 53B, 54B and 55B, respectively, on convex portion 95, and on circles 56B and 57B on conical portion 96. Circle 58B in this embodiment represents surface 97.

The first three sets of cutting elements 44 each have two cutter elements which are 180° apart. The next four cutter elements 53B, 54B, 55B and 56B, each have four cutter elements 44. These sets each have such cutter elements spaced 90° apart. Circle 57B has six cutter elements 44 which are spaced apart 60°. Finally, the last set of eight cutter elements 44 in circle 58B are spaced apart by 45°.

It will be further noted, whereas the first embodiment discloses four jet openings, the instant embodiment has six jet openings 70, such openings 70 being identical to those shown in FIG. 4, of the first embodiment.

From the foregoing, it will be appreciated in the second embodiment the gauge buttons have been increased from sixteen to twenty, the preform cutter elements have been increased from thirty-five to thirty-seven and the number of jet openings have been increased from four to six. The four outermost jets are centered at a radius of about 2.3168 inches from axis 102 and are spaced 90° apart. At the same time the space provided for the junk slots has also been enlarged.

Figure 8:
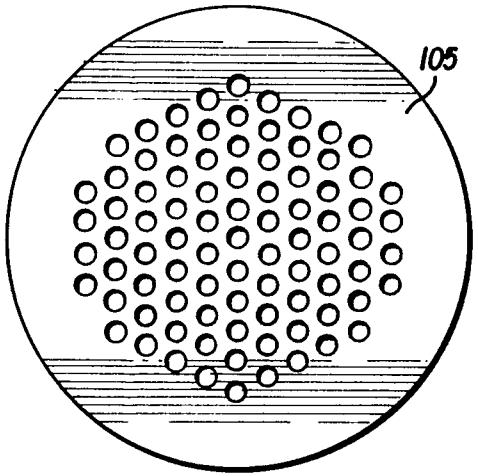
FIG. 8 is a plan view of a junk screen received in the bit's crown.
Figure 9:
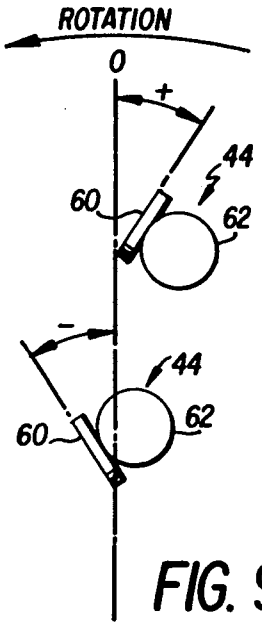
FIG. 9 illustrates the rake angles of preform cutter elements relative to the direction of rotation.

FIG. 8 discloses a junk screen 105 which may be optionally seated on shoulder 108 at fluid entrance 75B within crown 92 to prevent recirculation of junk in the drilling mud into fluid entrance 75B and under crown 92.

In an initial test of the second embodiment, bit 90 drilled 3204 feet in 183 continuous hours of drilling for an average of 17.51 feet per hour. It went into the hole at about 7300 feet.

Figure 10:
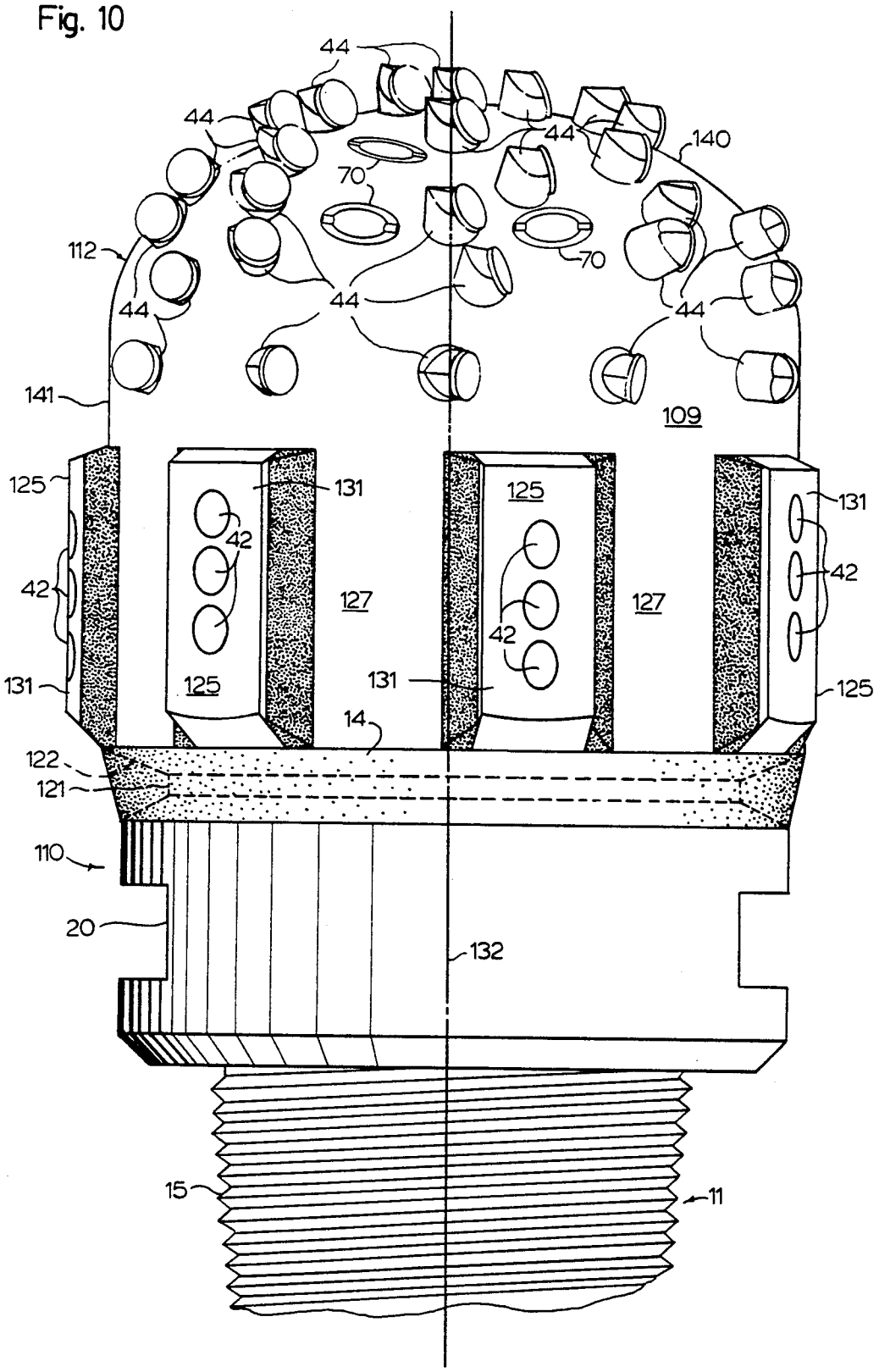
FIG. 10 is a side elevation of another embodiment of a drill bit in accordance with the invention.
Figure 11:
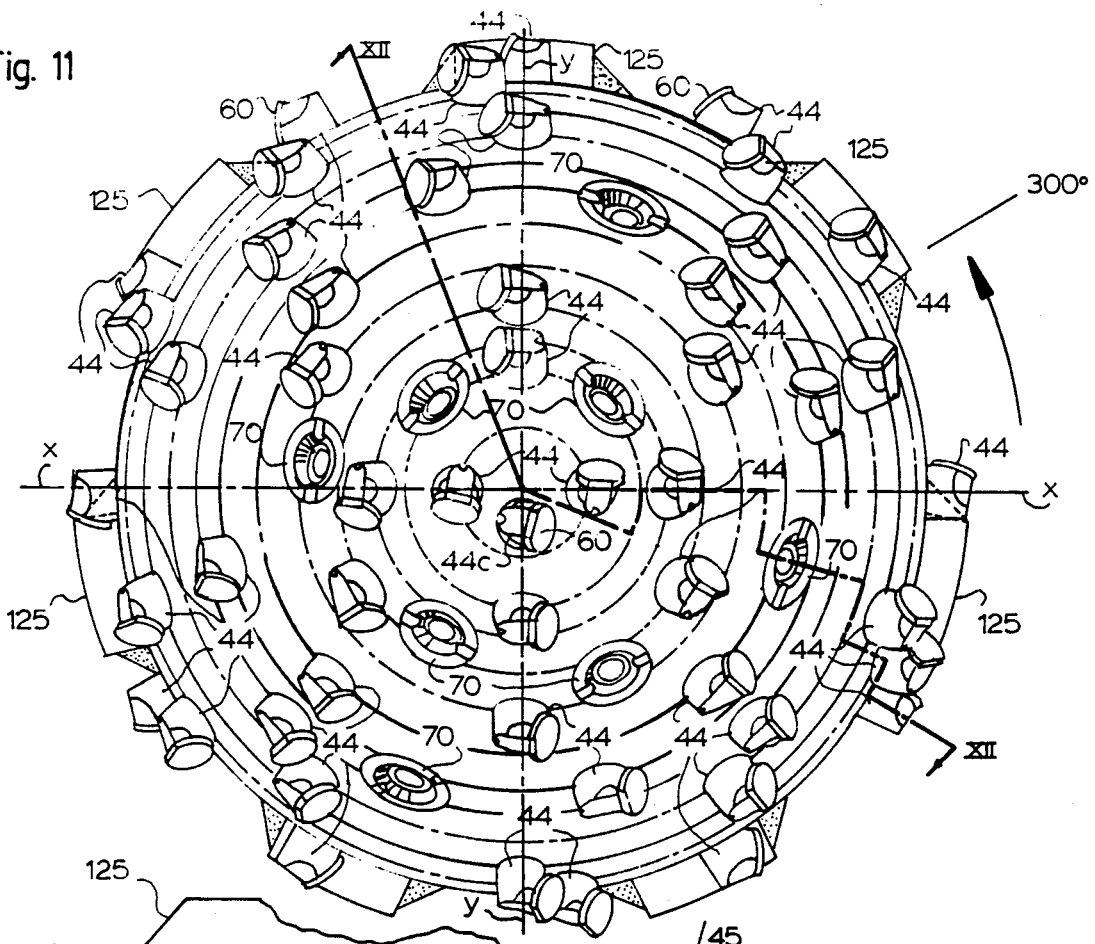
FIG. 11 is a view similar to FIGS. 2 and 6 of the embodiment shown in FIG. 10.
Figure 12:
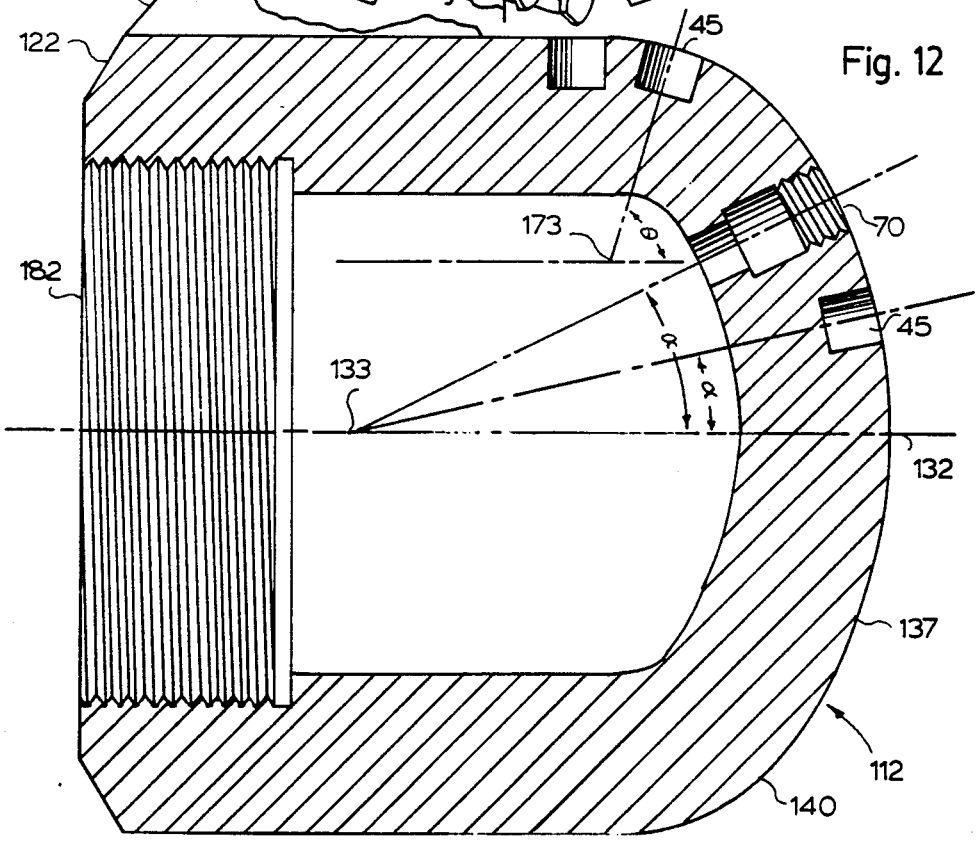
FIG. 12 is a sectional view of the bit of FIGS. 10 and 11 taken on lines 12—12 in FIG. 11.
Figure 14:
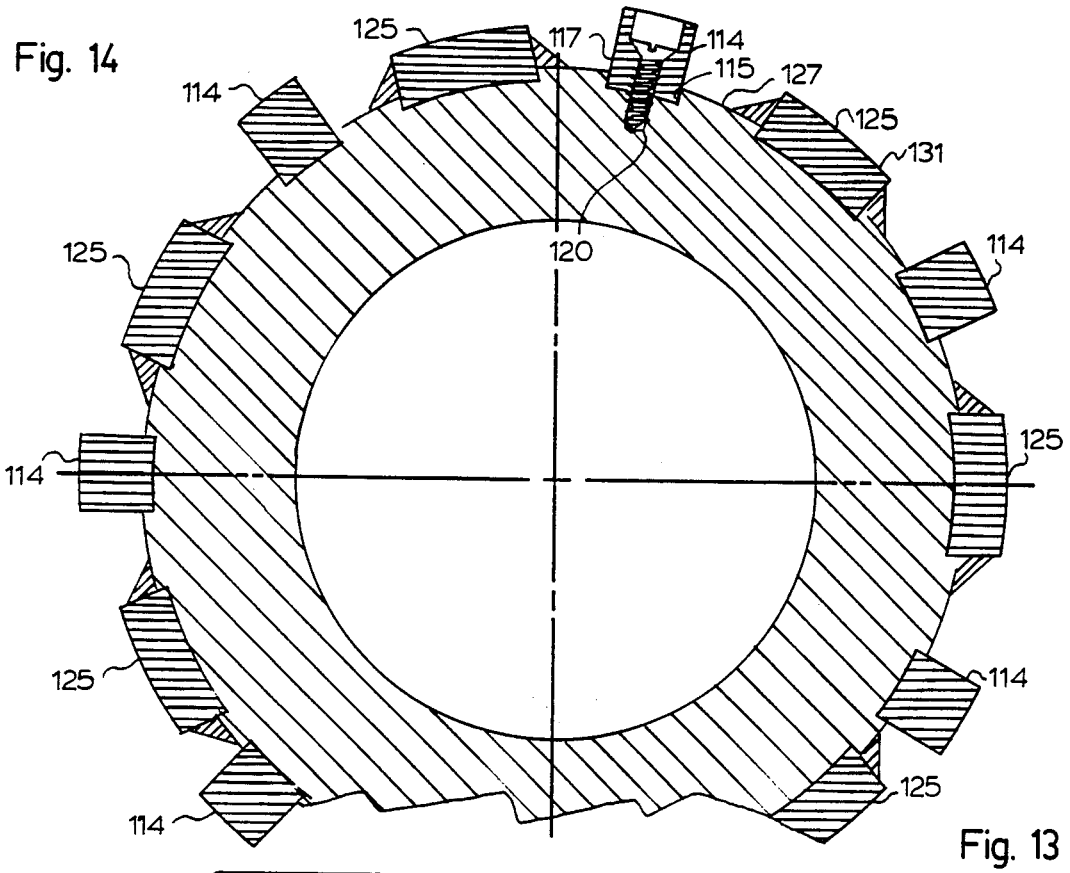
FIG. 14 is a side elevation view of the bit shown in FIG. 13 having the gage protectors installed.

In the embodiment shown in FIGS. 10, 11 and 12, the drill bit, designated generally by reference numeral 110, has a pin shank 11 which, except it is somewhat larger, is essentially the same as in the previous embodiments. Thus, for this component and others similar to those disclosed in the prior embodiments, the same reference numerals have been applied. In the crown 112 of drill bit 110, gage buttons 42 and preform cutter elements 44 are the same as in the prior embodiments. However, the specific locations of such elements 44 on crown 112 differs from the prior embodiments.

Pin shank 11 is welded to crown 12 about shoulder 122 and a further shank portion 121 by weld 14. The welding procedure involves preheating the area to be welded 400° to 500° F. and welding with AWS-ASTM 8018-B2 Electrodes, post-heating 450° to 550° F. and permitting the weld to cool with the bit 110 in an insulated box or under an asbestos blanket.

Crown 112 includes a bit face 137 which has a central convex portion 140 and a peripheral face portion 141.

The cylindrical sides which constitute surface 109 of bit 110, have seven raised portions or gage pads 125 welded thereto. Such gage pads 125 each have three aligned openings which receive gage buttons 42. Thus with seven gage pads 125, twenty-one gage buttons are required. The surface 131 of each gage pad 125 coincides with a cylinder having the same longitudinal axis 132 as the drill bit 110 and surface 109.

Figure 13:
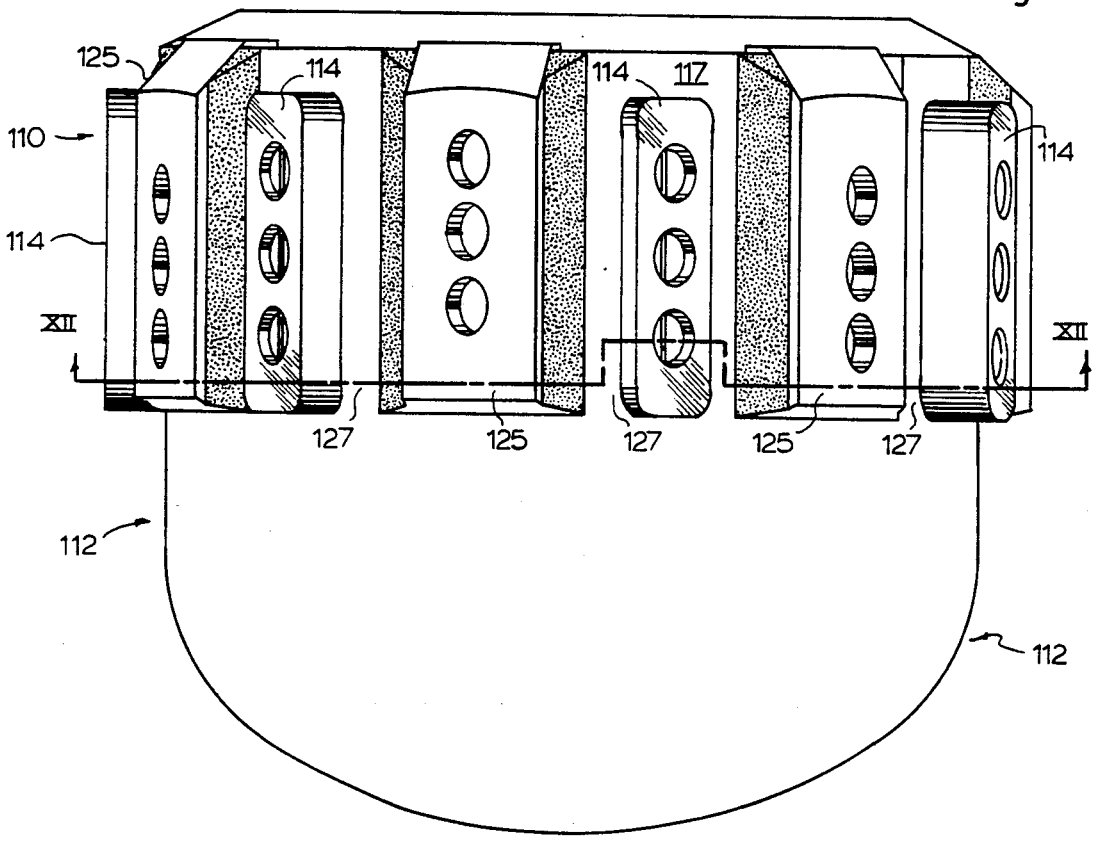
FIG. 13 is a view of the bit's crown similar to FIG. 11 on which gage protectors have been installed.
Figure 15:
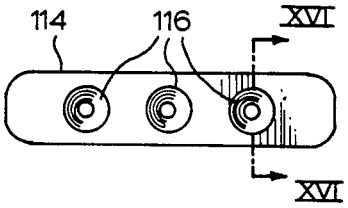
FIG. 15 is a detail view of a gage protector as installed on the bit shown in FIGS. 13 and 14.
Figure 16:
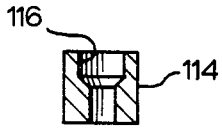
FIG. 16 is a sectional view taken on lines 16—16 in FIG. 15.

As with the previous embodiments, the preferred gage buttons are serrated compact General Electric type No. 59S3AH which have been pressed to be flush with the surface 131. It will be seen from FIG. 13 (as in FIG. 1) that each group of three gage buttons 42 is alternated in height with adjacent pads 125 so that in rotation their circular courses overlap.

With reference to the axis of rotation 132 of bit 110, the convex central face portion 140 has a radius of 5.9 inches from a point 133 on axis 132. The diameter of surface 109 is 8.820 inches. The radius of peripheral face portion 141 is 2.5 inches from a circle which is at a radium of 1.9125 inches from centerline 132 and its center is 2.82 inches in the direction of face 137 from point 133 measured along centerline 132. Such circle is indicated by point 173 in FIG. 12. The overall diameter of crown 112, considered as a cylinder coinciding with surfaces 131 of gage pads 125 is 9.825 inches. However, the preform cutter elements 44 farthest from axis 132 circumscribe a circle having a diameter of 9.875 inches. Thus, the tops of the outermost cutting blanks 60, as manufactured, cut an opening somewhat larger than the diameter circumscribed by the outer surfaces 131 of the gage pads 125.

Precise locations of preform cutter elements 44 on crown 112, as shown in FIG. 11, are set forth in the following Table II:

TABLE III

| NO. OF OPENINGS | RADIUS | α AND θ REF. | ANGLE COUNTER-CLOCKWISE FROM Y-AXIS OF EACH CENTERLINE 48 | RAKE ANGLE |
|---|---|---|---|---|
| 1 | .3210 | α 3.12 | 180° | 10 |
| 2 | .7244 | α 7.05 | 90°, 270° | 10 |
| 2 | 1.1428 | α 11.17 | 0°, 180° | 10 |
| 2 | 1.5739 | α 15.47 | 90°, 270° | 10 |
| 3 | 2.0096 | α 19.91 | 0°, 120°, 240° | 7½ |
| 3 | 2.4474 | α 24.51 | 60°, 180°, 300° | 7½ |
| 4 | 2.8864 | α 29.29 | 45°, 135°, 225°, 315° | 7½ |
| 4 | 3.2188 | θ 31.50 | 15°, 105°, 195°, 285° | 7½ |
| 4 | 3.5625 | θ 41.30 | 45°, 135°, 225°, 315° | 7½ |
| 5 | 3.8906 | θ 52.30 | 0°, 72°, 144°, 216°, 288° | 7½ |
| 5 | 4.1406 | θ 63.03 | 36°, 180°, 180°, 252°, | 7½ |

TABLE III-continued

| NO. OF OPENINGS | RADIUS | α AND θ REF. | ANGLE COUNTERCLOCKWISE FROM Y-AXIS OF EACH CENTERLINE 48 | RAKE ANGLE |
|---|---|---|---|---|
| | | | 324° | |
| 6 | 4.3203 | θ 74.39 | 6°, 66°, 126°, 186°, 246°, 306° | 7½ |
| 12 | 4.4125 | PERPENDICULAR TO CENTERLINE 48 | 0°, 30°, 60°, 90°, 120°, 150°, 180°, 210°, 240°, 270°, 300°, 330° | 7½ |

In this connection, it will be appreciated the angle constitutes the angle between the centerline of openings 45 (which eventually pass through centerline 132) and an intercepting line parallel to centerline 132 and displaced 1.9125 inches therefrom as shown in FIG. 12 whereby it passes through the circle containing point 172. This angle is, of course, the same as that which is defined by the interception of the centerline of the opening involved and axis 132. Thus both angles α and θ equal 90° minus the angle between a plane perpendicular to the centerline of the opening involved and centerline 132.

Comparing Table III and Table II, it will be noted that the sets of preform elements 44 are spaced slightly farther apart on the larger face 137 as compared to face 94. Following the most central cutter element 44C, there are twelve additional sets of cutter elements 44 in FIG. 11 with a number of cutter elements increasing from two in the set following the most central cutter element 44C to six on the last set of cutter elements on face 137 and finally to twelve in the twelfth set of cutter elements 44 that are spaced around the cylindrical surface 190. The first three cutter element sets have a rake angle of 10° whereas the remaining cutter sets have a rake angle of 7½.

The most central cutter element designated 44C has an edge which preferably coincides with the bit's axis of rotation 132 and the succeeding sets of cutter elements 44 are received in successive openings 45 which have their centerlines intersect with axis 132 as noted above. Each set of cutting elements is displaced from the adjacent cutter element of its set by the same arc measured in degrees which is equal to the degrees of arc resulting from dividing 360° by the number of cutter elements in the set.

Table IV which follows discloses the precise locations of the seven jet openings 70 as seen in FIG. 11 and in the same manner as described with reference to the sets of preform elements 44. Openings 70 are identical to those shown in FIG. 4 on the first embodiment.

TABLE IV

| NO. OF OPENINGS | RADIUS | α OR θ REF. | ANGLE COUNTERCLOCKWISE FROM Y-AXIS OF EACH CENTERLINE 48 |
|---|---|---|---|
| 2 | 1.3906 | α 13.63 | 45°, 315° |
| 1 | 1.8125 | α 17.89 | 150° |
| 1 | 2.2500 | α 22.42 | 207° |
| 1 | 2.8864 | α 29.29 | 85° |
| 1 | 3.0313 | α 30.92 | 255° |
| 1 | 3.2188 | θ 31.50 | 340° |
| 1 | 3.3125 | θ 34.06 | 159° |

As previously discussed, threaded portion 15 of the drill bit 110 is screwed into the lower end of a drill string comprising an interconnected series of drill pipes and this drill string is lowered into a bore hole of the well and rotated. In lowering drill bits in accordance with the instant invention, a problem has developed because the last set of preforms 44 which are perpendicular to the axis of rotation 132 of the drill bit extend beyond the gage pads 125 and tend to become damaged due to contact with the casing which by the same token is also scarred by the movement of the drill bit as it is lowered into the bore hole. To minimize this damage and to ensure the preforms reach the bottom of the bore hole in an undamaged condition, each bit has been provided with gage protectors in junk slots 127 as illustrated in FIGS. 13–16.

Thus, each junk slot 127 of head 112 (shown without elements 44) has machined therein a rectangular depression 115 which receives a gage protector 114. Each gage protector 114 consists of an aluminum body (6061TG Aluminum) which is 3½ inches long, ¾ inch in both width and depth and is provided with three apertures 116 which are countersunk to receive brass flathead screws 117 which are threadably received in corresponding threaded apertures 120 provided in each depression 115. From FIG. 13 it will be noted the upper surface of each screw 117 is about ¼ inch inboard of the circle circumscribed by the outer surfaces 131 of gage pads 125 and the upper surfaces of gage protectors 114 are about ¼ inch outboard of such circle and also above any circle circumscribed by the outermost parts of the cutter elements 44.

In operation, rotation of bit 110 causes the upper surfaces of the gage protectors 114 to wear down to a height approximately the same as the surfaces of the gage pads 125 (about 0.5 inches). Subsequently, when bit 110 is withdrawn from the casing, the gage protectors 114 can be easily removed and replaced.

Gage protectors 114 may be also advantageously composed of resilient materials such as elastomers, for example, a polyurethane, silicone or other material selected to withstand the heat and pressure conditions at the depths involved. They may, further, be mixed, say alternately aluminum and resilient material. They may, yet further, be oval or circular in configuration rather than rectangular.

Figure 17:
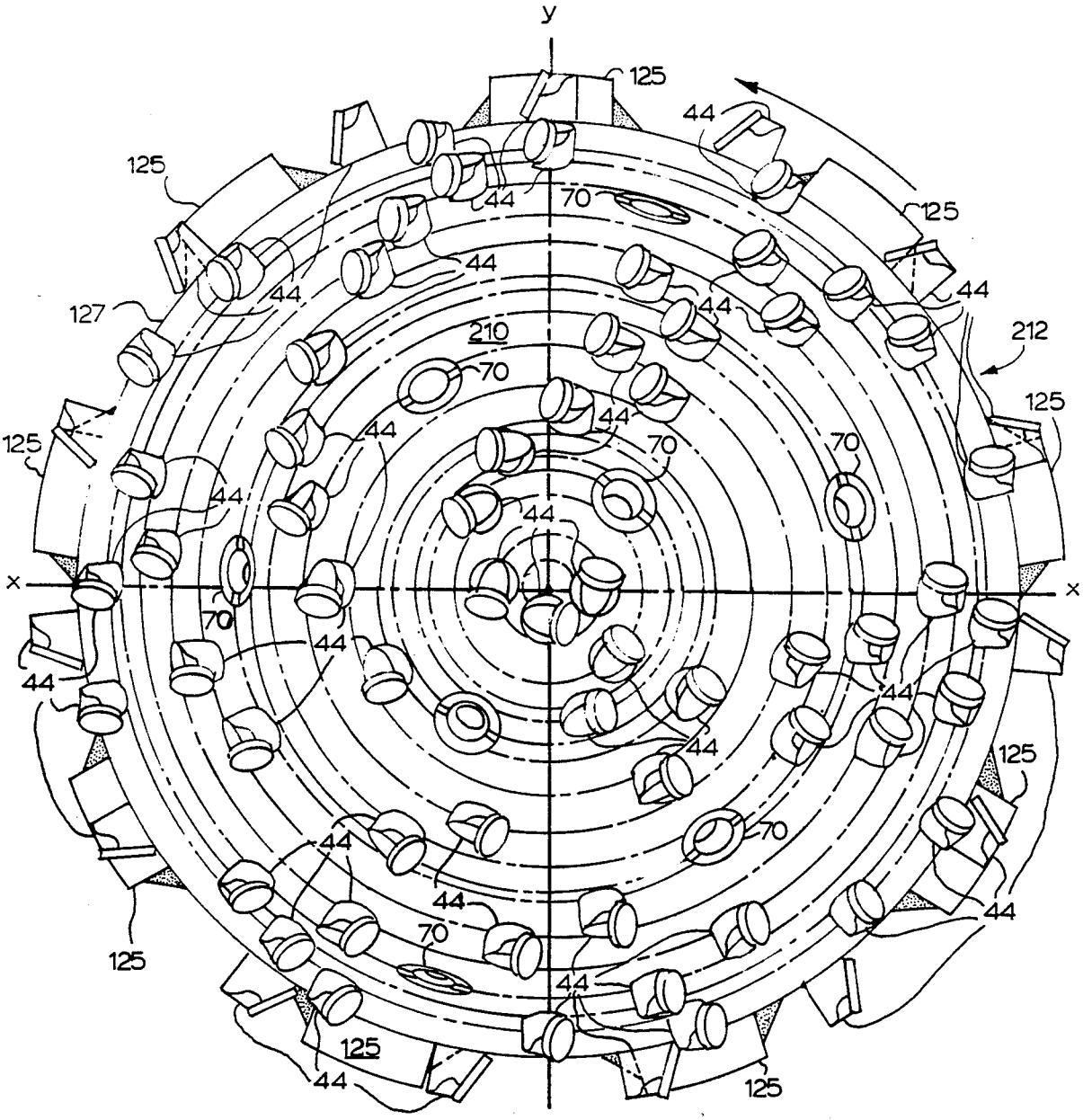
FIG. 17 is a view similar to FIGS. 2, 6 and 11 of a yet further embodiment of a drill bit in accordance with the invention.
Figures 18, 21, 22, 23:
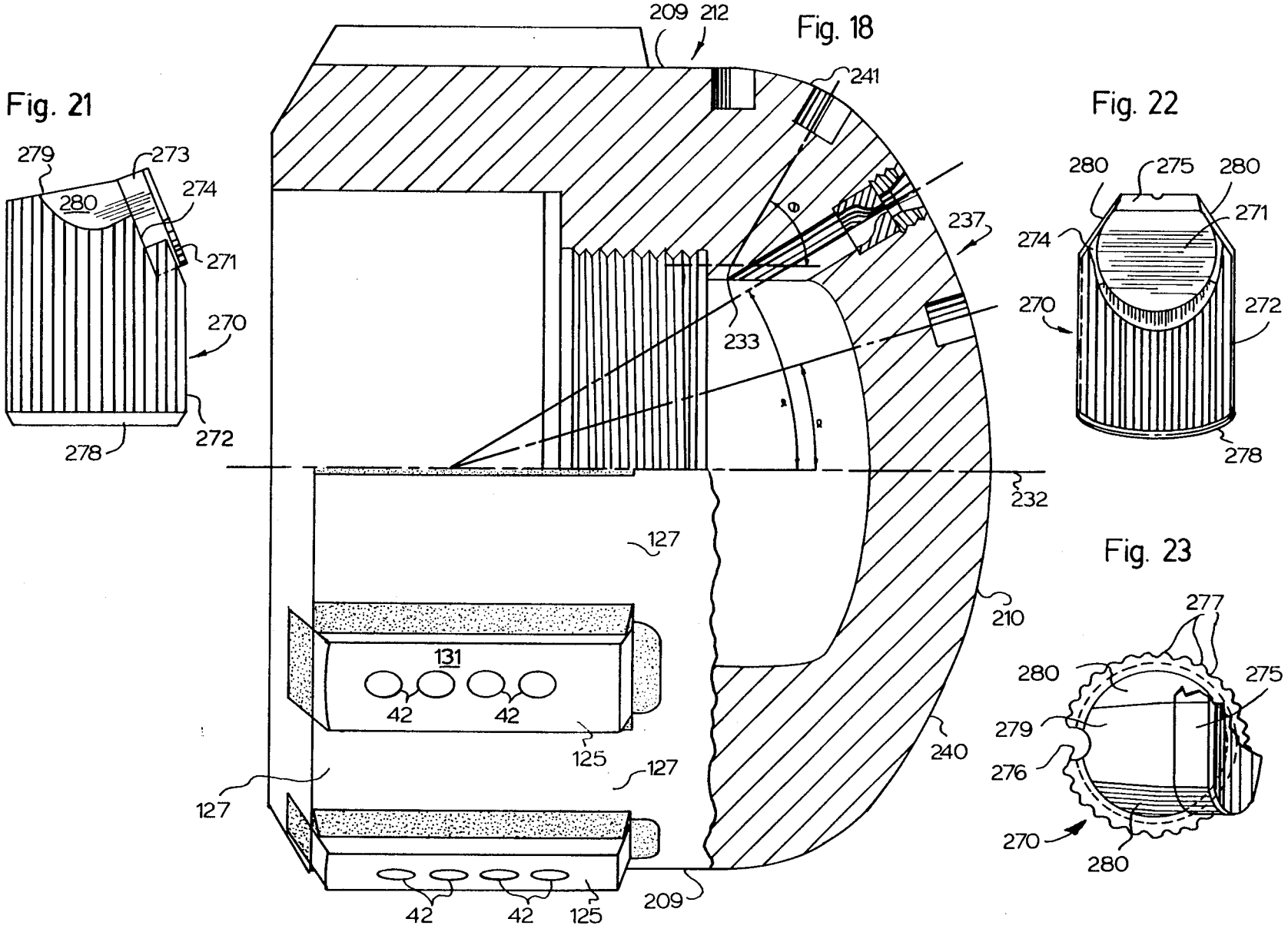
FIG. 18 is a view similar to FIGS. 3, 7 and 12 with the section partially broken to show the structure of the gage pads.
FIG. 21 is a side elevational view of a preform cutter element having serrated sides.
FIG. 22 is a front elevational view of the cutter element shown in FIG. 21.
FIG. 23 is a plan view of such cutter element.

In FIG. 17 and 18, a crown 212 for a drill bit 210 is shown. The pin shank for such drill bit 210 is essentially the same as shown in the other embodiments except for its size and, therefore, has not again been included in the drawings.

In crown 212 of drill bit 210, gage buttons 42 and preform cutter elements 44 are essentially the same as those shown in the first embodiment except for the specific locations of such elements on crown 212 and the discs and cutting faces are completely circular.

Crown 212 includes a bit face 37 which has a central convex portion 240 and a further curved periphery portion 241.

Cylindrical sides, surface 209, of crown 212 have nine gage pads 125 welded thereto. Each such gage pads 125 has four vertically aligned openings receiving gage buttons 42. Thus, with nine gage pads 125, thirty-six gage buttons 42 are required. As before, preferred are serrated compact General Electric type gage buttons (No. 59S3AH) which are press fitted flush with surface 131 of gage pads 125.

Spaces between gage pads 125, identified by reference numerals 127, function as junk slots.

The axis of rotation for the drill bit which carries crown 212 is axis or centerline 232. Central face portions 240 have a radius of 7.60 inches from a point 233 on axis 232. The diameter of circular surface 209 is 11.2 inches. The overall diameter of crown 212, considered as a cylinder coinciding with the surfaces 131 of gage pads 125 is 12.175 inches.

The radius of the peripheral portion 241 is 2.75 inches normally outwardly from a circle having a radius of 2.85 inches from axis 232 and having its center 3.9299 inches from point 233 along axis 232 towards central face 240. The preform cutter elements 44 contained in surface 209 and farthest from axis 232 circumscribe a circle having a diameter of 12.205 inches. Thus, the upper aspects of the outermost cutting blanks 60, as manufactured, cut an opening somewhat larger than the diameter of the circle circumscribed by the outer surfaces 131 of the gage pads 125.

The precise locations of preform cutter elements 44 of crown 212, as shown in FIG. 17, (including angles $\alpha$ and $\theta$) are set forth in the following Table V:

TABLE V

| ROW | NO. OF OPENINGS | RADIUS | $\alpha$ AND $\theta$ REF. | ANGLE COUNTERCLOCKWISE FROM Y-AXIS OF EACH CENTERLINE 48 | RAKE ANGLE |
|---|---|---|---|---|---|
| 1 | 1 | .3438 | $\alpha$ 3.15 | 180° | 10 |
| 2 | 2 | .6754 | $\alpha$ 5.09 | 90°, 270° | 10 |
| 3 | 2 | 1.1205 | $\alpha$ 8.47 | 45°, 225° | 10 |
| 4 | 2 | 1.5780 | $\alpha$ 11.98 | 15°, 195° | 10 |
| 5 | 3 | 2.0350 | $\alpha$ 15.53 | 113°, 233°, 355° | 10 |
| 6 | 3 | 2.4864 | $\alpha$ 19.10 | 90°, 210°, 330° | 10 |
| 7 | 4 | 2.9294 | $\alpha$ 22.67 | 73°, 165°, 255°, 345° | 7½ |
| 8 | 4 | 3.3617 | $\alpha$ 26.25 | 60°, 150°, 240°, 330° | 7½ |
| 9 | 5 | 3.7813 | $\alpha$ 29.84 | 45°, 117°, 189°, 261°, 343° | 7½ |
| 10 | 5 | 4.1864 | $\theta$ 33.47 | 30°, 102°, 174°, 246°, 318° | 7½ |
| 11 | 6 | 4.5733 | $\theta$ 38.81 | 21°, 85°, 150°, 210°, 270°, 378° | 7½ |
| 12 | 6 | 4.8953 | $\theta$ 48.05 | 12°, 75°, 135°, 195°, 255°, 315° | 7½ |
| 13 | 8 | 5.1660 | $\theta$ 57.37 | 0°, 45°, 90°, 144°, 180°, 225°, 266°, 305° | 7½ |
| 14 | 8 | 5.3779 | $\theta$ 66.81 | 15°, 60°, 105°, 153°, 198°, 240°, 285°, 330° | 7½ |
| 15 | 15 | 5.6000 | PERPENDICULAR TO CENTERLINE | 0°, 24°, 48°, 72°, 96°, 120°, 144°, 168°, 192°, 216°, 240°, 264°, 288°, 312° 336° | 7½ |

It will be noted that following the most central cutter element 44D in FIG. 17, there are fourteen additional sets of cutter elements 44. The central most cutter element designated 44D has an edge which preferably coincides or almost coincides with the axis of rotation 232. The first three sets of cutting elements 44 thereafter each have two cutter elements which are 180° apart. The next two sets of cutter elements have three elements in each set which are 120° apart. The next two sets of cutter elements have four elements each about 90° apart. The eighth and ninth set of cutter elements have five elements each of which are 72° apart. The tenth and eleventh set of cutter elements have six elements each which are about 60° apart. The remaining sets of cutter elements, except for the last set in surface 209, have eight cutter elements each which are about 45° apart. Finally, the last row of cutter elements in surface 209 is provided with fifteen cutter elements which are disposed 24° apart.

Crown 212 is provided with eight jet openings 70, such openings 70 being identical to those previously shown, are located in this embodiment as indicated in Table VI.

TABLE VI

| ROW | NO. OF OPENINGS | RADIUS | $\alpha$ AND $\theta$ REF. | ANGLE COUNTERCLOCKWISE FROM Y-AXIS OF EACH CENTERLINE 48 | RAKE ANGLE |
|---|---|---|---|---|---|
| 1 | 1 | 1.4375 | $\alpha$ 10.90 | 319° | N/A |
| 2 | 1 | 1.8750 | $\alpha$ 14.28 | 150° | N/A |
| 3 | 1 | 2.8125 | $\alpha$ 21.72 | 30° | N/A |
| 4 | 1 | 3.6250 | $\alpha$ 28.48 | 215° | N/A |
| 5 | 1 | 3.7500 | $\alpha$ 29.56 | 87° | N/A |
| 6 | 1 | 3.7813 | $\alpha$ 29.84 | 285° | N/A |
| 7 | 1 | 4.7500 | $\theta$ 43.70 | 345° | N/A |
| 8 | 1 | 4.8953 | $\theta$ 48.05 | 165° | N/A |

In usage, the crown together with the preform cutter members supported by the crown are the most likely components of the drill bit to be subjected to abuse and suffer damage. For this reason and in view of substantial benefits incident to manufacturing procedures, it was considered advantageous to produce a composite drill bit wherein the pin shank and the portion of the crown below the area for supporting the preform cutter members were separate parts, and were potentially reusable although firmly connected together for the drilling operations. The method also permits the use of the same pin shank for different size drill bits.

Figure 19:
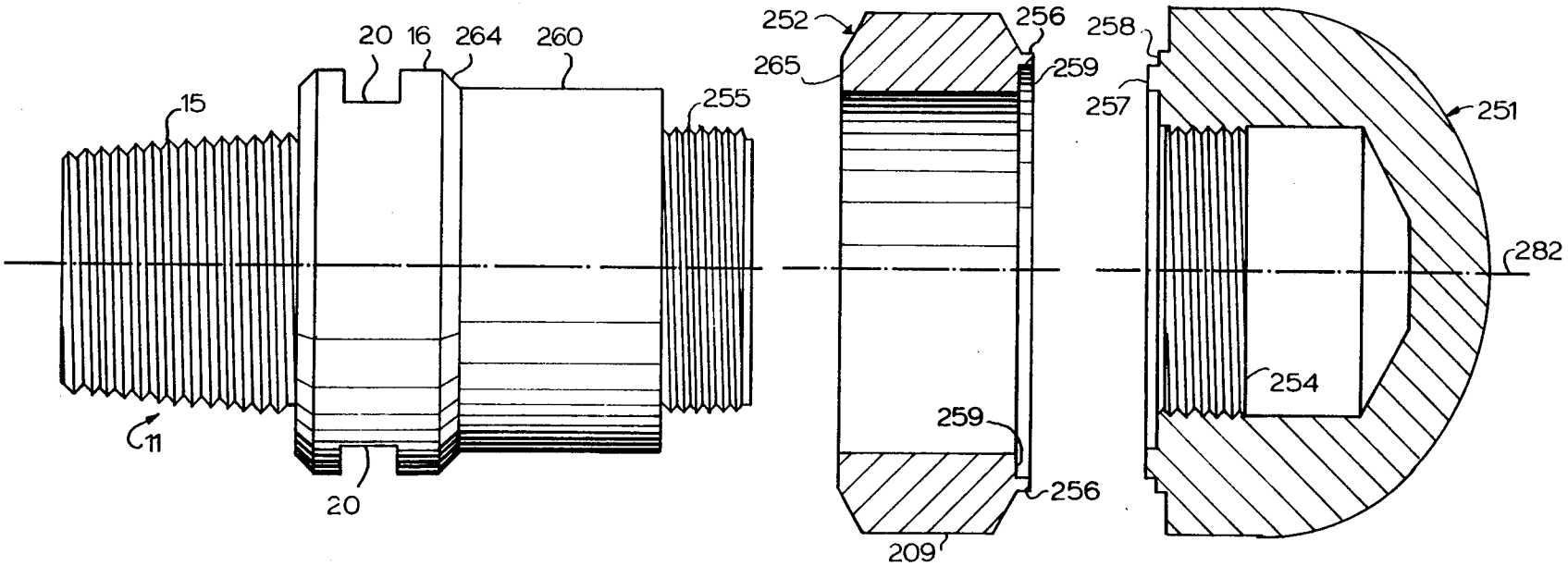
FIG. 19 is an expanded view of a three-part drill bit with the spacer and cap shown in cross section.

The expanded view of FIG. 19 illustrates a drill bit 250 for drilling a 12¼ inch diameter hole, similar in dimensions and exterior configurations to drill bit 210, which is manufactured as three separate main components, the pin shank 11, a body spacer 252 and a cap 251. Such components are composed of ASTM 4130 steel.

It will be noted pin shank 11 includes a threaded connection 15, a shank 16 with a pair of breaker slots 20, a spacer support 260 for slidably receiving body spacer 252 and external threads 255 to be threadably received by internal threads 254 of cap 251.

Figure 20:
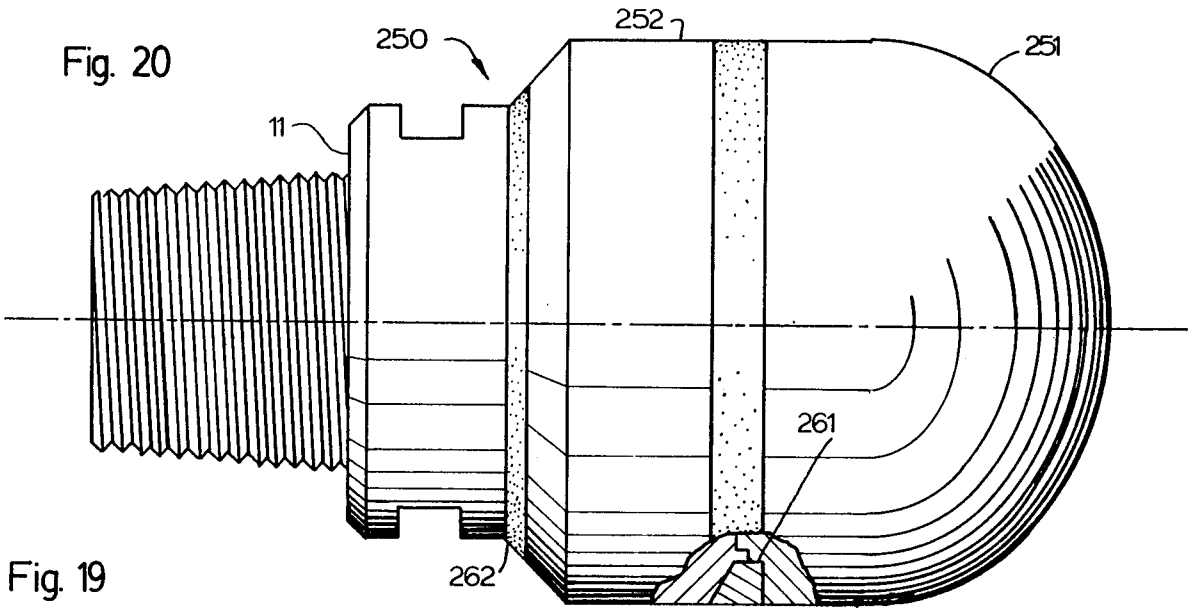
FIG. 20 is a side elevation of the drill bit shown in FIG. 19 welded together which is in partial section to show the weld between the body spacer and cap.

Body spacer 252 and cap 251 are welded together as indicated in FIG. 20 with a circular outer flange 256 received around the circular inner flange 257 and abutting against shoulder 258 while the circular inner flange 257 abuts against a shoulder 259 in body spacer 252. The assembly is preheated to a temperature in the range of 400° to 500° F. Then using an AWS-ASTM 8018-82 electrode, weld 261 is applied with the temperature of the adjacent steel not permitted to rise about 600° F. Thereafter, the welded assembly is maintained at 400° F., postheated to within the 450° to 550° F. and slowly permitted to cool to ambient temperature in an insulated box or under an asbestos blanket.

When sufficiently cool, weld 261 is machined to be flush with surface 209. The composite head is then milled to receive the gage protectors and gage pads and gage pads having gage buttons as previously disclosed (gage pads 125) are welded to surface 209. Thereafter, preform cutter elements 44 are applied by boring openings 45 at the desired locations and inserting the elements 44. Finally the gage protectors 114 are secured in place.

Following the foregoing operations, pin shank 11 is secured to cap 251 by causing external threads 255 to be received by internal threads 254. This causes shank bevel 264 to bear against the inboard portion of shoulder 265. Because bevel 264 is coincident with the surface of a truncated core, having the same centerline as drill bit 250, this ensures alignment of the three primary components of pin shank 11, body spacer 252 and cap 251 and placed body spacer 252 somewhat in compression whereas spacer support 260 of pin shank 11 is somewhat in tension. At this point, weld 262 is applied between pin shank 11 and body spacer 252 using the same procedure as for weld 261.

FIGS. 21, 22 and 23 illustrate a preform cutter element 270 which may be used in lieu of element 44. Such element 270 comprises a base portion pin 272 which has a twenty degree flat front bias part 274 to which a disc 273 is firmly attached. Disc 273 is provided with a cutting face 271 which is composed of a combination of polycrystalline (man-made) diamonds and cemented tungsten carbide. It is essentially the same as cutter blank 60 except that a sector has been removed to provide the top of disc 273 and cutting face 271 with a plane surface 275.

In pin 272, to the rear of cutting face 271, a channel 76 has been machined which, as with the previous preforms, is intended to receive a lock pin to assist in securing it in opening 45 in its desired position which establishes the rake angle of face 271. At its upper sides, the edges of pin 272 are removed leaving a pair of flat areas 280 which are disposed 30° relative to the pin's vertical sides as seen in FIG. 22. Pin 72 has adjacent its bottom a 15° bevel 278.

The cylindrical surface of pin 272 is provided with a plurality (thirty-one) serrations 277 which are disposed at right angles to the bottom on pin 272. Top 279 of pin 272 comprises a flat area which meets the rear upper edge of disc 273 and extends rearwardly therefrom at an angle of 10° between areas 280 relative to the bottom of pin 272. Pin 272 has an overall height of 0.966 inches and has an overall diameter of 0.651 inches. Serrations 277 have a depth of 0.019 inches and the sides are disposed in vertical planes which intersect at 90° angles. They are also rounded somewhat in their valleys, that is on the inner corners, and also are rounded on outer edges.

Each preform cutter element 270 guided by pin 67 in an aligned notch or channel 276, is mounted by being pressed (with 20,000 psi pressure) into a selected one of openings 45 which have diameters of 0.635 inches, serrations 277 cutting into the sides of openings 45 to provide an extremely rigid and secure connection between cap 251 and cutter elements 270. Cutter element 270 is composed of tungsten carbide except for disc 273 and cutting face 271 which have a composition previously described. In practice, serrated cutter elements 270 have proved significantly less subject to breakage than cutter elements 44.

Figure 26:
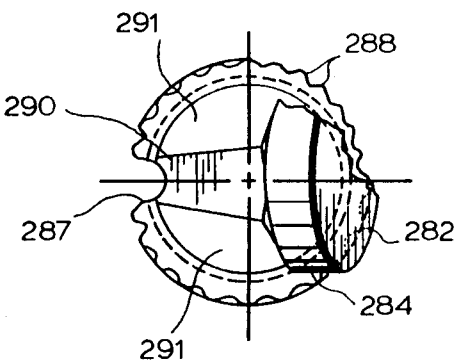
FIG. 26 is a plan view of the latter cutter element.
Figure 25:
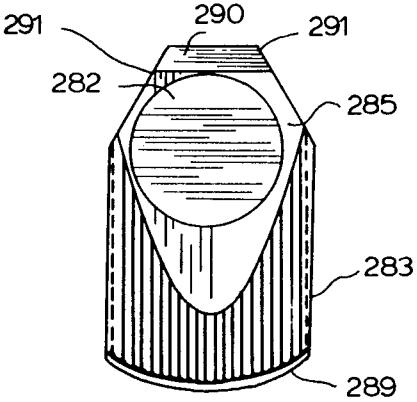
FIG. 25 is a front elevational view of the cutter element shown in FIG. 24.
Figure 24:
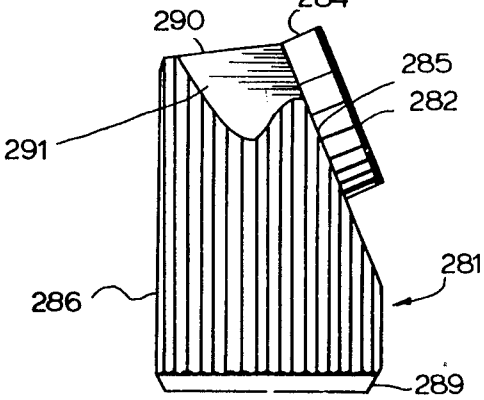
FIG. 24 is a side elevational view of another embodiment of a preform cutter element having serrated sides.
Figure 30:
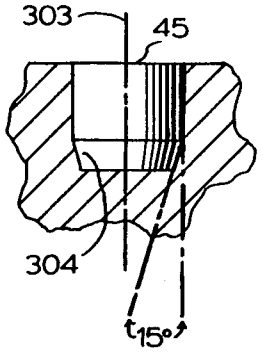
FIG. 30 is a sectional view of an opening for receiving the cutter element of FIGS. 27–29.

FIGS. 24–26 are directed to a cutter element 281 which is similar to cutting element 270. Element 281 comprises a pin or stud 286 having along its vertical sides a plurality of serrations 288 and at its bottom a bevel 289. Firmly secured on a coplanar front bias part 285, which is inclined 70° rearwardly from bottom to top, is a disc 284 provided with a cutting face 282. Disc 284 and cutting face 282 are the same as the previously described disc 273 and cutting face 271 except that disc 284 and face 282 are completely circular as seen in FIG. 25 rather than having a sector removed at the top.

Stud 286 has an alignment notch or channel 287 machined at its rear which is intended to receive a lock pin that assists it in being secured in an opening 45 with the desired rake angle. Along its upper sides, the edges of stud 286 are removed leaving a pair of flat side areas 291 which are disposed 30° relative to the studs vertical sides as seen in FIG. 25. Adjacent its bottom, the bevel 289 is 15° relative to the vertical. The upper side or top of stud 286 includes a plane surface 290 which meets the rear upper edge of disc 284 and extends rearwardly therefrom at a downward inclination of 10°.

Serrations 288 are, in cross section, substantially the same as serrations 277.

As in the previous embodiment, each element 281, guided by a pin 67 in an opening 66 and in its elongated notch 287, is mounted on the drill bit head concerned by being pressed with about 20,000 pounds per square inch pressure into a selected one of openings 45 which each have a diameter of 0.635 inches. Serrations 288 cut into the sides of the selected opening 45 to provide an extremely rigid and secure connection between the bit's face and the element 281. Element 281 is composed of tungsten carbide except for disc 284 and cutting face 282 which are essentially the same as cutter blank 60, face 282 being composed of a combination of polycrystalline (man-made) diamonds and cemented tungsten carbide.

Figure 29:
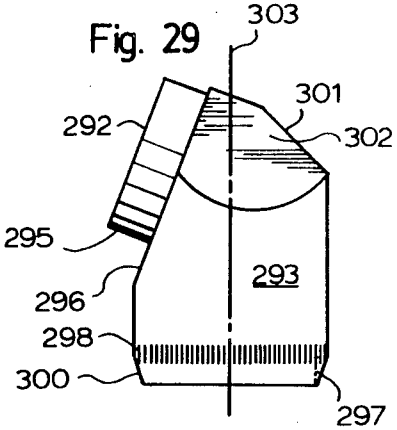
FIG. 29 is a side elevational view of the cutter shown in FIG. 28.
Figure 28:
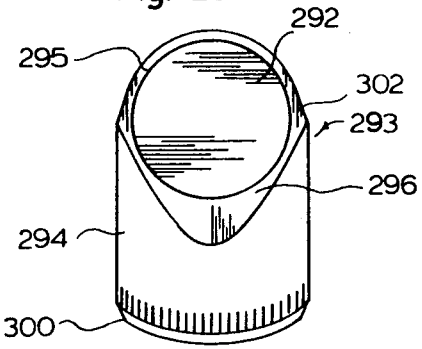
FIG. 28 is a front elevational view of a further embodiment of a preform cutter element with the serrations only at the bottom.
Figure 27:
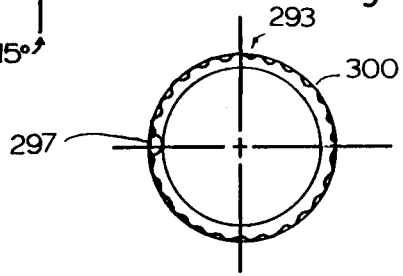
FIG. 27 is a bottom view of a further embodiment of a cutter element having serrations only at the bottom of the element.

The cutter element 293 shown in FIGS. 27–29 has serrations 289 only around the bottom end of stud 294 to provide a locking action against turning. The upper portion of stud 294 is smooth to maximize strength and eliminate possible stress risers cause by the serrations. Stud 294 has a coplanar front bias surface 296 whereon a disc 295 is firmly secured, such disc having a cutting face 292 composed of a combination of polycrystalline (man-made) diamonds and cemented tungsten carbide. Disc 295 and cutting face 292 are essentially identical to disc 284 and cutting face 282, respectively. Element 293 is provided with a radiused top portion 302 which, as indicated above, is smooth but includes, however, an upper coplanar bevel portion 301 which is at a 45° angle to the stud's longitudinal axis 303 (and of opening 45). All edges of surface 296 and portion 301 are rounded to inhibit stress risers. At the rear of stud 294 extending within bevel 300 is an alignment notch comprising a short channel 297 which has been reduced so that it is just sufficient to provide proper alignment of stud 294 on installation of same in opening 45 of the drill bit's face. The surface next to the edge of opening 45 is marked for alignment with channel 297 and stud 294 is so aligned before being pressed into opening 45. At the lower aspect of each element 293, the bevel 300 is provided and the serrations 298 project into such bevel 300. There are a total of twenty-eight serrations around the circumference of element 293. The height of each bevel 300 is 0.10 inches and the serrations 298 which have a vertical dimension of 0.1515 project 0.0375 inches into bevel 300.

As in the previous embodiments, the front bias surface 296 is inclined to the rear at 20° relative to the stud's vertical axis 303.

The cross section of serrations 289 is essentially the same as serrations 277 except, of course, serrations 289 are somewhat wider, there being seven for each quadrant.

For elements 293, openings 45 are preferably biased 75° about surface 304 at the bottoms thereof or have a somewhat less stepped-in radius at the bottom obtained by first driling the opening and then reaming to size. Each stud 294 has an overall diameter which is 0.003 inches greater than each opening 45 and therefore, after alignment with groove 297, is pressed into opening 45. At the bottom of opening 45, serrations 298 are pressed (again with 20,000 pounds psi pressure) into the surfaces 304 having less diameter. This, it has been found, provides a highly secure connection of each element 293 to the bit's face while, at the same time, eliminating potential problems due to stress along serrations such as serrations 288 and 277.

Studs 294 are composed of cobalt-chromium-tungsten alloys. The hardness of the serrations 298 expressed in terms of the A-scale, Rockwell Hardness Number, is preferably not less than eighty-five whereas the steel surfaces defining openings 45 does not usually have a hardness in excess of sixty-three based on the same scale. The high hardness and compression strength of serrations contribute to a practically unbreakable bond between the bit's drilling head and the elements 293. Other known alloys, particularly high carbon-tungsten-molybdenum wear-resistant alloys designed to withstand the impacts, pressures and vibrations encountered in oil and gas well drilling operations may be used for the same purpose.

In operations, the bit 10, 90, 110, 210 or 250 is affixed by means of the threaded connection 15 on the end of a rotating drill pipe inside a casing, the drill pipe being lowered as drilling progresses. A heavy artificial "mud" is circulated down through the drill pipe, into the bit's fluid entrances, out through the bit's jet openings, around element 44 or 270, and back up via the junk slots and the casing. The accumulated junk, that is the rock fragments and the like, caused by the drilling action and carried up the casing by the mud, is filtered out before the mud is recirculated into the drill pipe. Any junk missed by such filtering is stopped by a screen 105 as disclosed in the second embodiment. A relax oil base type drilling mud with mud weight of about 12.2 to 15.4 has been used with success. The bit face velocity at its periphery is in a range of about 275 to 325 feet per second.

The drawings are reasonably to scale. They are intended to disclose the relationship of the various components whether or not specifically described as such in the foregoing specification. Claim language directed to the various elements of the invention should be construed to cover corresponding structure in the specification and equivalents thereof. For example, "rake angle" of a cutter element is intended to refer to the rake angle illustrated in FIG. 9. Also, it is to be understood that although preferred embodiments of the invention have been described above, the inventive concepts may be applied to other adaptations and modifications within the scope of the appended claims.

Having described my invention, what I claim as new and to be secured by Letters Patent of the United States is:

1. A drill bit for oil or gas wells which comprises a pin shank, a drill head threadably connected to said pin shank and a body spacer in compression which is affixed to said pin shank and said head, a cylindrical bit body having an end surface and a side surface, said side surface including a plurality of gage pads, each said gage pad affixed in part to said head and in part to said body spacer and fluid channels defined between said gage pads, a plurality of cutters mounted on said end surface, one said cutter disposed to rotate proximate the bit's axis of rotation, a first set of cutters disposed at a first equal radius from said axis and displaced through equal arcs around said axis, and further successive sets of cutters disposed further radii equal in each said set and being displaced from each other by equal arcs in each said set around said axis, said cutters tracing circular cutting paths around said axis which overlap and substantially cover the entire area of said end surface.

2. A drill bit in accordance with claim 1 wherein said body spacer is in a state of compression and the area of said pin shank which bears against said body spacer causing it to be in said state coincides with the surface of a truncated core having a longitudinal centerline coinciding with the axis of rotation of the drill bit.

3. A drill bit in accordance with claim 2 wherein said pin shank is welded to said body spacer along said area.

4. A drill bit in accordance with claim 3 wherein said body spacer is welded to said head by a weld which is flush with any part of said side surface, said gage pads extending across said weld and being welded to said side surface including said weld.

5. A drill bit for oil or gas wells which comprises a shaft, a cylindrical steel bit body affixed to said shaft, said bit body having an end surface and a side surface, said side surface including a plurality of vertically deposited raised portions spaced around its circumference and fluid channels defined between said raised portions, a plurality of cutters mounted on said end surface, one said cutter disposed to rotate proximate the bit's axis of rotation, a first set of cutters disposed at a first equal radius from said axis and displaced through equal arcs around said axis, and further successive sets of cutters disposed further radii equal in each said set and being displaced from each other by equal arcs in each said set around said axis, said cutters tracing circular cutting paths around said axis which overlap and substantially cover the entire area of said end surface, a set of cutters extending normally from said side surface for a distance greater than the distance of said raised portions above the remaining part of said side surface, gage protectors secured to said side surface in said channels, said gage protectors extending from said side surface normally a distance beyond the greatest outboard projections of said cutters of said set which extend normally from said side surface.

6. A drill bit in accordance with claim 5 wherein each said gage protectors are composed of a material which is softer than steel.

7. A drill bit in accordance with claim 6 wherein said gage protectors are composed of aluminum.

8. A drill bit in accordance with claim 6 wherein said gage protectors are secured to said side surface by a plurality of countersunk screws received in said side surface and extending normally therefrom a distance less than the distance said raised portions extend therefrom.

9. A drill bit in accordance with claim 6 wherein said gage protectors are, at least in part, composed of a resilient material.

10. A drill bit in accordance with claim 9 wherein said resilient material is an elastomer.

11. A drill bit in accordance with claim 10 wherein said elastomer is polyurethane.

12. A drill bit in accordance with claim 10 wherein said elastomer is silicone.

13. A drill bit for oil or gas wells which comprises a shaft, a cylindrical bit body affixed to said shaft, said bit body having an end surface and a side surface, said side surface including a plurality of raised portions comprising gage pads and fluid channels defined between said raised portions, a plurality of cutters mounted in openings provided on said end surface, each said cutter comprising a supporting pin, each said pin composed of a material substantially harder than the material of said end surface surrounding said openings and including sides which have vertical parallel serrations, said pins pressed in said openings to cut corresponding serrations in the sides of said openings of such a character to secure said pins rigidly in said openings substantially integral with said bit body, one said cutter disposed to rotate proximate the bit's axis of rotation, a first set of cutters disposed at a first equal radius from said axis and displaced through equal arcs around said axis, and further successive sets of cutters disposed further radii equal in each said set and being displaced from each other by equal arcs in each said set around said axis, said cutters tracing circular cutting paths around said axis which overlap and substantially cover the entire area of said end surface.

14. A drill bit in accordance with claim 13 wherein said pin is composed of tungsten carbide and said material surrounding said openings is steel.

15. A drill bit in accordance with claim 14 wherein each said cutter comprises a cutting disc which is rigidly connected to and supported by said pin to project immediately above said end surface.

16. A drill bit in accordance with claim 15 wherein each said disc is composed of polycrystalline diamonds having a tungsten carbide substrate.

17. A drill bit in accordance with claim 16 wherein each said disc has a flat forward cutting surface which has a rearward inclination of about 20° relative to a line perpendicular to said end surface through such disc.

18. A drill bit in accordance with claim 13 comprising at least thirty-five said cutters.

19. A bit in accordance with claim 16 wherein at least some of said discs have a planar cutting face which has a negative rake angle relative to its path of travel.

20. A drill bit in accordance with claim 19 wherein said negative rake is in a range of 0° to 10°.

21. A drill bit in accordance with claim 16 wherein at least some of said discs have planar faces and have a positive rake angle relative to its path of travel.

22. A drill bit in accordance with claim 21 wherein said positive rake angle is between 0° and 10°.

23. A drill bit for oil and gas wells which comprises a shaft, a generally cylindrical steel bit body affixed to said shaft, said bit body having an end cutting surface and a side surfaee, said end cutting surface being convex, a plurality of cutters mounted in openings in said end surface, each said cutter comprising a supporting pin composed of tungsten carbide and including sides which have parallel vertical projections, said pins pressed into said openings to cut grooves corresponding to said projections in the sides of said openings of such character to secure said pins rigidly in said openings substantially integral with said bit body, a first set of said cutters disposed in a first circular cutting path at a first equal radius from said axis which are displaced from each other around said axis by arcs of equal degrees, a further successive set of said cutters disposed in a second circular cutting path a further radius from the axis of rotation of the bit farther than said first radius and which are also displaced from each other by equal degrees of arc, there being a greater number of said cutters disposed along said second cutting path than said first cutting path, said cutters in said second cutting path being closer together as measured along said second cutting path than said cutters in said first cutting path as measured along said first cutting path.

24. A drill bit in accordance with claim 23 wherein said bit body's side surface includes a plurality of raised portions comprising gage pads and fluid channels defined between said raised portions.

25. A drill bit in accordance with claim 24 wherein there are five said raised portions, the width of each of said channels being approximately twice the width of each said raised portion.

26. A drill bit in accordance with claim 25 wherein another set of said cutters are provided to extend from said side surface between the ends of said raised portions and said convex surface.

27. A method of manufacturing a steel drill bit for oil and gas wells which comprises the steps of:

Producing a cylindrical cap having a threaded interior opening opposite a convex surface of the crown;

Producing a cylindrical body spacer having the same diameter as said cap and a bore there through with an interior diameter larger than that of said threaded interior opening, said bore having the same longitudinal centerline as the cylindrical surface of said body spacer;

Producing a pin shank having a connection for a shaft to rotate same, a shank which includes in sequence a breaker slot and a bevelled portion having the surface of a truncated cone with its longitudinal axis coincident with the axis at rotation of the pin shank, a cylindrical support for said body spacer, and a threaded portion corresponding to said interior threaded opening;

Welding said body spacer to said cap with their respective cylindrical surfaces aligned and machining said weld to be flush with said surfaces;

Applying gage pads to said cylindrical surfaces across said weld and mounting cutters on said cap;

Inserting said pin shank's spacer support through said body spacer's bore and screwing said pin shank's threaded portion into said cap's internal threaded opening until said pin shank's bevelled portion is urged against the edge of said bore; and Welding said pin shank to said body spacer over said bevelled portion while said body spacer is in a state of compression.

* * * * *